US008286397B2

(12) United States Patent
Shaw

(10) Patent No.: US 8,286,397 B2
(45) **Date of Patent: *Oct. 16, 2012**

(54) FIRE BARRIERS FOR THE SPACES FORMED BY INTERSECTING ARCHITECTURAL EXPANSION JOINTS

(75) Inventor: Alan Shaw, Lockport, NY (US)

(73) Assignee: Fireline 520, LLC, Buffalo, NY (US)

( * ) Notice: Subject to any disclaimer, the term of this patent is extended or adjusted under 35 U.S.C. 154(b) by 124 days.

This patent is subject to a terminal disclaimer.

(21) Appl. No.: 12/827,033

(22) Filed: Jun. 30, 2010

(65) Prior Publication Data

US 2010/0275539 A1 Nov. 4, 2010

Related U.S. Application Data

(63) Continuation-in-part of application No. 11/295,910, filed on Dec. 7, 2005, now abandoned, which is a continuation-in-part of application No. 10/894,112, filed on Jul. 19, 2004, now Pat. No. 6,996,944, which is a continuation-in-part of application No. 10/854,392, filed on May 26, 2004, now abandoned.

(51) Int. Cl.
*E04C 2/00* (2006.01)

(52) U.S. Cl. ..... 52/232; 52/396.01

(58) Field of Classification Search ..... 52/232, 52/1, 396.01, 273

See application file for complete search history.

(56) References Cited

U.S. PATENT DOCUMENTS

| | | | | | |
|---|---|---|---|---|---|
| 4,977,719 | A | * | 12/1990 | LaRoche et al. | 52/396.01 |
| 5,974,750 | A | * | 11/1999 | Landin et al. | 52/396.01 |
| 6,012,869 | A | * | 1/2000 | Braun | 404/64 |
| 6,128,874 | A | * | 10/2000 | Olson et al. | 52/232 |
| 6,131,352 | A | * | 10/2000 | Barnes et al. | 52/396.01 |

* cited by examiner

*Primary Examiner* — Basil Katcheves
(74) *Attorney, Agent, or Firm* — Patricia M. Costanzo

(57) ABSTRACT

Multi-layered, fire-barriers each sized and shaped for installation into accepting intersection-spaces formed by the spaced-intersection of at least two expansion-joint spaces that occur between two adjacent spaced structural building units, each of said expansion-joint spaces defined by a plane, said plane defined by a set of three non-colinear points with each point defined by a set of x, y, z coordinates from the same coordinate system with no two of said coordinate sets being identical. The fire-barriers are shaped for use in 2-way planar, L-shaped expansion-joint spaces, T-shaped, cross-shaped, V-shaped, and vertical/horizontal L-shaped corner expansion-joint spaces, for example, and may comprise at least one layer of: protective cloth, insulating blanket, intumescent material, and mechanically supporting layer. The barriers prohibit the travel of fire, heat, or smoke through the flue-like channels created by the expansion-joints of a structure are provided ready to install in a one-step, drop-in process.

20 Claims, 24 Drawing Sheets

FIRE BARRIERS FOR THE SPACES FORMED BY INTERSECTING ARCHITECTURAL EXPANSION JOINTS

CROSS-REFERENCE TO RELATED APPLICATIONS

This Application is a Continuation-in-Part of U.S. patent application Ser. No. 11/295,910 filed Dec. 7, 2005, which is a Continuation-in-Part of U.S. patent application Ser. No. 10/894,112 filed Jul. 19, 2004, now U.S. Pat. No. 6,996,944, which is a Continuation of U.S. patent application Ser. No. 10/854,392 filed May 26, 2004, now abandoned.

STATEMENT REGARDING FEDERALLY SPONSORED RESEARCH OR DEVELOPMENT

Not Applicable

REFERENCE TO SEQUENCE LISTING, A TABLE OR A COMPUTER PROGRAM LISTING COMPACT DISK APPENDIX

Not Applicable

BACKGROUND OF THE INVENTION

The present invention relates generally to fire-barriers and more particularly to one-step, drop-in installation, intersection-space fire-barriers sized and shaped for installation into accepting intersection-spaces formed by the spaced intersection of at least two expansion-joint spaces that each occur between different sets of adjacent spaced structural building units, each of said expansion-joint spaces defined by a plane, said plane defined by a set of three non-collinear points with each point defined by a set of x, y, z coordinates from the same coordinate system with no two of said coordinate sets being identical.

The background information discussed below is presented to better illustrate the novelty and usefulness of the present invention. This background information is not admitted prior art. The particular versions of the invention as described below are provided, in part, as illustrative and exemplary. Thus, the described versions should not be taken as limiting. Additionally, the invention is not limited to the examples provided.

Customarily, buildings were built with static joints. Modern building codes, however, require that building design and construction take into account factors that can, over time, change the physical dimensions of a structure. These factors include extreme or repetitive changes in temperature, the force of wind impinging on the building, forces due to seismic events, settling of the subsoil, remodeling of the building, or excavation on or near the site, among other factors. To accommodate the stress on a structure caused by these factors without compromising the integrity of the building, architects and builders design the structure in sub-units where each sub-unit is spaced a small distances away from each of its neighboring sub-units creating spaces referred to as either "expansion-joint spaces," expansion-joints," or, "joint-spaces." Structural sub-units include wall, floor, and ceiling units.

Expansion-joints provide for differential building and building unit movement to take place without risking damage to the whole structure. These joints can widen or narrow to accommodate differential movement of the adjacent spaced structural units and/or can reduce the stress caused by shear motion of the adjacent structural units. Dynamic moveable joints are also often referred to in the trade as "construction joints," "soft joints," "dynamic voids", and "seismic joints." Expansion-joints or voids often occur, for example, where two wall sections, a wall and a floor, or a wall and ceiling meet, for example.

While the presence of expansion-joints improves the integrity of the structure as a whole, they present a major risk to the structure in the event of a fire. The joint-spaces provide pathways for flame, heat, and smoke to spread rapidly throughout the structure by utilizing what is known as the "chimney effect," which provides for an updraft of heated air rising through the structural gaps. Building codes for commercial structures generally require the installation of tested fire-barriers capable of preventing flame and smoke from passing through expansion-joints into adjoining areas.

Some of the earliest fire-barriers available include fire retardant and/or intumescent putties, caulks, wraps, and mats. These fire-barrier products however, although suitable for static joints, are generally not suitable for acting as fire-barriers for dynamic joints. To reduce the risk created by the chimney effect due to the spaces associated with dynamic expansion-joints, a number of attempts have been made to block the joints with fire resistant materials. A dynamic expansion-joint fire-barrier needs to be capable of accommodating the complex differential movement of the building structural units and to retain its resiliency over an extended period of time under dynamic conditions. Further, during a fire event, the joint is likely to be subject to even greater stress, thereby making it essential that the fire-barrier retains its integrity to prevent the migration of heat, flame, and smoke.

Some of the earliest commonly available fire-barriers were generally made of fire resistant materials, such as fire brick, which typically may be either rigid and/or brittle, or fire-barrier blankets constructed of refractory fibers that are flexible but can be easily damaged.

In order for the rigid and brittle materials to be used to seal building joints while maintaining a degree of flexibility requires first creating hollowed out regions within the structural units that meet at a joint that is to be sealed with a fire-barrier. The fire-barrier, which consists of a thin layer of material of appropriate high-temperature properties, is then inserted into both hollowed gaps at the ends of the adjacent structural units. Thus, the widening or narrowing or shear motion of the adjacent plates is accommodated by the fire-barrier moving in a sliding fashion within the adjacent structural units. As long as the lateral dimensions of the barrier exceed the widest distance between the adjacent structural units during differential movement, the integrity of the barrier should remain. Similarly, when the structural units move towards each other, the barrier should remain undamaged providing that the lateral dimension of the barrier is less than the distance between the bottoms of the hollowed out regions of the structural units. The major drawback of this approach is that the fire resistant material must be thin enough to fit within the hollowed-out areas of the adjacent structural units. Moreover, fabricating the hollowed-out areas further complicates the construction of the building and increases the cost of the construction. Moreover, correct installation of such a barrier in a pre-existing building is difficult and expensive.

On the other hand, fire resistant materials fabricated into thin, flexible fibers can be incorporated into flexible, fire resistant structures resembling a blanket. The advantages of such a material are that the fabrication is not very expensive, the draping of the blanket across a joint is readily accomplished, and any differential movement of the adjacent structural units can be accommodated by incorporating an appropriate amount of slack in the blanket during installation. The blanket, however, is mechanically weak and can be easily damaged by tearing or ripping either accidentally or intentionally during or after installation thus largely compromising the integrity of the fire-barrier. A number of attempts have been made to protect the blanket from such mechanical damage. These have generally relied on the fabrication of a composite blanket which incorporates the fire resistant material between layers of a stronger, protective material such as metal foils or metal screens. The fire resistant layer can freely move with respect to these protective layers or they may be attached together via threads or similar attaching means.

Given the wide variety of movements that may occur between structural elements in a building, particularly one situated in a seismically active region, there still remains the possibility of gaps appearing in the fire-barrier. To reseal these gaps in the event of a fire, intumescent materials are frequently added to the barrier. These are materials that expand when rapidly heated and at the same time have fire resistant properties. Thus, these provide a second method of sealing the structural gap in a building.

SUMMARY

The present Inventor, realized that not only did the above problems require better solutions, he also came to realize that these attempts, at best, were limited to providing "straight-line" fire-barriers for installation into straight-line expansion-joints, Straight-line-joints are those that occur between two parallel spaced building structures, such as between two adjacent, but spaced, wall units. Expansion spaces can be characterized as belonging to one of two categories. Straight-line expansion-joint-spaces are one category. The second category is referred to as the intersection-space category and consists of those spaces that are formed by the spaced-intersection of at least two expansion-joint spaces where each occurs between different sets of two adjacent spaced structural building units, each of said expansion-joint spaces defined by a plane, said plane defined by a set of three non-collinear points with each point defined by a set of x, y, z coordinates from the same coordinate system with no two of said coordinate sets being identical. Thus, a great number of intersection-spaces occur when two or more straight-line expansion-joint spaces intersect to create a cross-shaped intersection space, or, for example, where two exterior walls and an interior wall meet creating a "T"-shaped spaced-intersection space.

The present Inventor, realizing that presently, there are no fire-barriers that are sized and shaped for one-step, drop-in installation to seal such intersection-spaces. He recognized that if such fire barriers could be achieved the safety factor in a fire would tremendously increase. Thus, he set above to develop fire-barriers for intersection-spaces.

Accordingly, the present Inventor, developed a set of principles that provide for a series of intersection-space fire-barriers that ideally are constructed as one piece, ready to install units to better ensure the integrity of the barrier during the installation process. These principles also provide for rapid and easy installation of the intersection-space fire-barriers by, in many cases, only one installer, and also provide for installation tools.

The present invention is able to prevent the rapid spread of flames, heat, and smoke throughout a building by virtue of having each intersection-space fire-barrier manufactured as a contiguous one-piece unit, shaped and sized to fit snugly into an accepting intersection-spaces. The contiguous one-piece construction provides no openings through which smoke, flame, or gases can pass.

The intersection-space fire-barriers made according to the principles of the present invention are generally manufactured to specification and thus, are provided ready to install. One preferred version of the invention comprises a barrier made using a three layer construction that includes a layer of protective cloth, an insulating material layer (insulation blanket), and an intumescent material layer. The three layers are affixed together to form a fundamental layer using high-temperature resistant means. This barrier is not, however, the typical straight-line or strip-type barrier that consists of one or more fire resistant layers simply superimposed one over the other.

An intersection-space fire-barrier made according to the principles of the present invention is unique in several ways. One point of novelty is the variety of three-dimensional configurations that can be accomplished using a fundamental layer regardless of the number or kinds of layers used to construct the fundamental layer. For example, in one aspect, a fire-barrier of the present invention is shaped into a contiguous one-piece L-shaped barrier to be inserted directly into an intersection-space that is a corner intersection-space. The L-shaped barriers can be shaped so that both legs of the "L" can be described as being in the same plane or so that one leg of the "L" is in plane that is perpendicular to the plane of the other leg. Another aspect is an intersection-space barrier sized and shaped as one contiguous unit to fit into a "T" shaped intersection-space created by the spaced convergence of three structural building units, such as three wall units, for example. In yet another aspect, an intersection-space fire-barrier is sized and shaped as one contiguous unit to fit into a cross-wise or 4-way shaped intersection-spaces created by the spaced convergence of four structural corner building units, such as when four corner-wall units meet, for example. An additional aspect is an intersection-space fire-barrier sized and shaped as one contiguous unit to fit into a vertical/horizontal 90° intersection-space. Another alternative is an intersection-space fire-barrier that is sized and shaped as one contiguous unit to fit into an intersection-space comprising a 45° angle. Yet another intersection-space fire-barrier is sized and shaped as one contiguous unit to fit into what is referred to as a vertical-horizontal T-shaped intersection-space where a T-shaped intersection-space has an additional joint-space intersecting the otherwise horizontal "T" at a right angle.

Yet another unique feature of the present invention is that regardless of the type of intersection-space the fire-barrier is intended to fit, all of the barriers are designed to have contraction and expansion capabilities. Additionally, each of the materials used in the construction of the fire-barriers meet Underwriters Laboratory, Inc. required specifications for materials used in a fire-barrier. Furthermore, on Jul. 22, 2006, the vertical/horizontal "L"-shaped intersection-space fire-barrier was tested in accordance with ASTM E 1966-01 *Standard Test Method for Fire Resistive Joint Systems*; UL 2079 *Test for Fire Resistance of Building joint Systems* for a fire endurance rating or 2 and 3 hours; and ASTM E 1399 movement cycling classification of Type IV. The product met the conditions for certification.

Thus, the invention principles, as described, make available the above described advantages by providing for intersection-space fire-barriers for use in intersection-spaces, wherein the fire-barriers may comprise a plurality of fire resistant material layers. The fire resistant material layers may be connected together by stitching, stapling, using pins and bolts, using adhesive, or by any other bonding or connection method.

The intersection-space fire-barriers following the present invention principles, as taught may be operatively manufactured as preassembled, one piece, drop-in units for use in a corner junction expansion-joint, a "T'-shaped expansion-joint, or in a 4-way expansion-joint, a horizontal 90° expansion-joint, an expansion-joint comprising a 45 degree angle, and a horizontal/vertical T-shaped joint having an additional arm that comes in at a right angle to the otherwise horizontal, planar, T-shaped barrier, for example.

The intersection-space fire-barriers, according to the principles of the present invention may further comprise a plurality of fire resistant material layers including at least one mechanical support layer, at least one insulating layer, and at least one layer of intumescent material, wherein the insulating layer is disposed between the mechanical support layer and the one intumescent layer; and where the layers are bonded together substantially continuously along their edge areas to provide for intersection-space fire-barriers operatively adapted for fitting into intersection-space architectural expansion-joints.

The mechanical support and protective cloth layer may be made from continuous filament amorphous silica yarns, polymeric material, fiber reinforced polymeric material, metalized fiber reinforced polymeric material, metalized, fiberglass cloth material, or inorganic fiber cloth material. The inorganic fibers may be selected from glass or ceramic fibers.

The insulating layer may be made from refractory ceramic fiber that may consist of alumina-silica, polycrystalline mullite, or glass mat materials.

The intumescent layer of the intersection-space fire-barriers, may be selected from a group consisting of unexpanded vermiculite, hydrobiotite, water-swelling tetrasilicic fluorine mica, expandable graphite, or mixtures thereof. The intumescent layer may comprise a blend of fibers, wherein said fibers are selected from the group consisting of refractory ceramic fibers, high-temperature resistant glass fibers, or unexpanded vermiculite.

The method for making the intersection-space fire-barriers may comprise the steps of:

providing for fire-barriers sized and shaped for installation into accepting intersection-spaces formed by the spaced-intersection of at least two expansion-joint spaces that each occur between different sets of two adjacent spaced structural building units, each of the expansion-joint spaces defined by a plane, the plane defined by a set of three non-colinear points with each point defined by a set of x, y, z coordinates from the same coordinate system with no two of said coordinate sets being identical, providing for each fire-barrier to be a layered fire-barrier comprising:

at least one layer of protective cloth, at least one insulation blanket layer, at least one layer of intumescent material, at least one layer of a mechanical support layer folding and joining said layers so as to form a fire-barrier ready for one-step drop-in installation within the accepting intersection-space, and attaching said barrier to the structural building units using mounting devices.

Further preferred embodiments, include fire-barriers for installation into spaces formed by the spaced-intersection of architectural expansion-joints comprising approximately right-angled, acute-angled, and obtuse-angled intersections of at least two architectural expansion-joints, comprising fire-barriers for installation into flue-like fire, heat, and smoke funneling spaces formed by the angled intersections of at least two architectural expansion-joints, comprising:

Intersection-space fire-barriers comprising a plurality of fire resistant material layers include, for example:

a first layer comprising:

a protective cloth sheet having a first and second surface, and a first insulation blanket sheet having a first and second surface, the second surface of said protective cloth sheet positioned under and contiguous to the first surface of the first insulation blanket sheet providing protection and mechanical support for the fire-barrier;

at least one layer of a first fire resistant intumescent material sheet arranged on the second surface of the first insulation blanket sheet;

a first fire resistant resilient mechanical support sheet having a first and second surface, the first surface of said first resilient mechanical support sheet positioned over the second surface of the first insulation blanket having a layer of the intumescent sheet, and a second layer comprising:

a second fire resistant insulation blanket sheet having a first and second surface, at least one layer of a second fire resistant intumescent material sheet arranged on the second surface of the second insulation blanket sheet, and a second fire resistant resilient mechanical support sheet having a first and second surface, the first surface of the second resilient mechanical support sheet positioned over the second surface of the second insulation blanket having a layer of the second intumescent sheet;

the second layer positioned over the first layer so that the first surface of the second insulation blanket is positioned over the second surface of the first resilient mechanical support sheet, the layers locally bonded together forming a unitary layered fire-barrier ready for installation within the spaces formed by the expansion-joints intersecting at various angles for affixation to the structural building units forming said expansion-joints providing for a barrier against the travel of fire, heat, or smoke through the flue-like expansion-joints of a structure.

In still furthermore preferred embodiments, the protective cloth of the intersection-space fire-barriers further includes mounting means for affixing the layered intersection-space fire-barrier to the building structural units, wherein the mounting means comprise flanges attached to the side edge portions of the protective cloth, and wherein the mounting means further comprise a plurality of fasteners used in conjunction with the flanges providing for the intersection-space fire-barrier to be affixed to building structural units, and further comprising wherein a plurality of fasteners further comprises a plurality of pins and washers.

The invention as described may further comprise a reusable mounting tool for depositing the intersection-space fire-barrier within intersection-spaces for affixation to building structural units, using at least one reusable mounting tool comprising a rigid frame that is reversibly attachable to each of intersection-space fire-barriers using reversible attachment means, such as, but not limited to pins and washers, and where each frame has at least one grasping means, such as a handle on the frame providing for easy lifting and positioning of the frame along with the intersection-space fire-barrier, which is reversibly attached to the frame, into said expansion-joints. The width of the mounting tool is adjustable to accommodate the width of the intersection-space fire-barrier, which accommodates the width of the expansion-joints that are intersecting at 90 degree angles. Moreover, the reusable mounting tools are available in a kit of mounting tools containing installation tool frames for installation of various sized and shaped fire-barriers into various sized and shaped spaces formed by the intersection of architectural expansion-joints comprising various angled intersections of at least two architectural expansion-joints.

A preferred embodiment includes wherein the intersection-space fire-barriers are contoured in the form of a cross for fitting into a planar intersection of four architectural expansion-joints, a T-shape for fitting into a planar angled intersection of three architectural expansion-joints architectural expansion-joints, an L-shape for fitting into a planar angled intersection of two architectural expansion-joints, and an L-shape for fitting into a non-planar angled intersection of two architectural expansion-joints, wherein the non-planar angled intersection of two architectural expansion-joints, comprises an intersection of an vertically oriented expansion-joint with a horizontally oriented expansion-joint.

Also included in the preferred embodiment are methods for installing intersection-space fire-barriers into fire, heat, and smoke funneling joint-spaces formed by essentially angled intersections of at least two architectural expansion-joints, comprising the steps of:

providing for intersection-space fire-barriers comprising a plurality of fire resistant material layers including:

a first layer comprising:

a fire resistant protective cloth; sheet having a first and second surface, and a first fire resistant insulation blanket sheet having a first and second surface, the second surface of the protective cloth sheet positioned under and contiguous to the first surface of the first insulation blanket sheet providing protection and mechanical support for the fire-barrier;

at least one layer of a first fire resistant intumescent material sheet arranged on the second surface of the first insulation blanket sheet;

a first fire resistant resilient mechanical support sheet having a first and second surface, the first surface of the first resilient mechanical support sheet positioned over the second surface of the first insulation blanket having a layer of the intumescent sheet, and a second layer comprising:

a second fire resistant insulation blanket sheet having a first and second surface, at least one layer of a second fire resistant intumescent material sheet arranged on the second surface of the second insulation blanket sheet, and a second fire resistant resilient mechanical support sheet having a first and second surface, the first surface of said second resilient mechanical support sheet positioned over the second surface of said second insulation blanket having a layer of the second intumescent sheet;

positioning said second layer over said first layer so that the first surface of the second insulation blanket is positioned over said second surface of the first resilient mechanical support sheet, bonding said layers locally together forming a unitary layered fire-barrier ready for installation within the spaces formed by the intersection of said expansion-joints.

Still other benefits and advantages of this invention will become apparent to those skilled in the art upon reading and understanding the following detailed specification and related drawings.

BRIEF DESCRIPTION OF THE DRAWINGS

In order that these and other objects, features, and advantages of the present invention may be more fully comprehended, the invention will now be described, by way of example, with reference to the accompanying drawings, wherein like reference characters indicate like parts throughout the several figures, and in which.

DEFINITIONS

Figure 1:
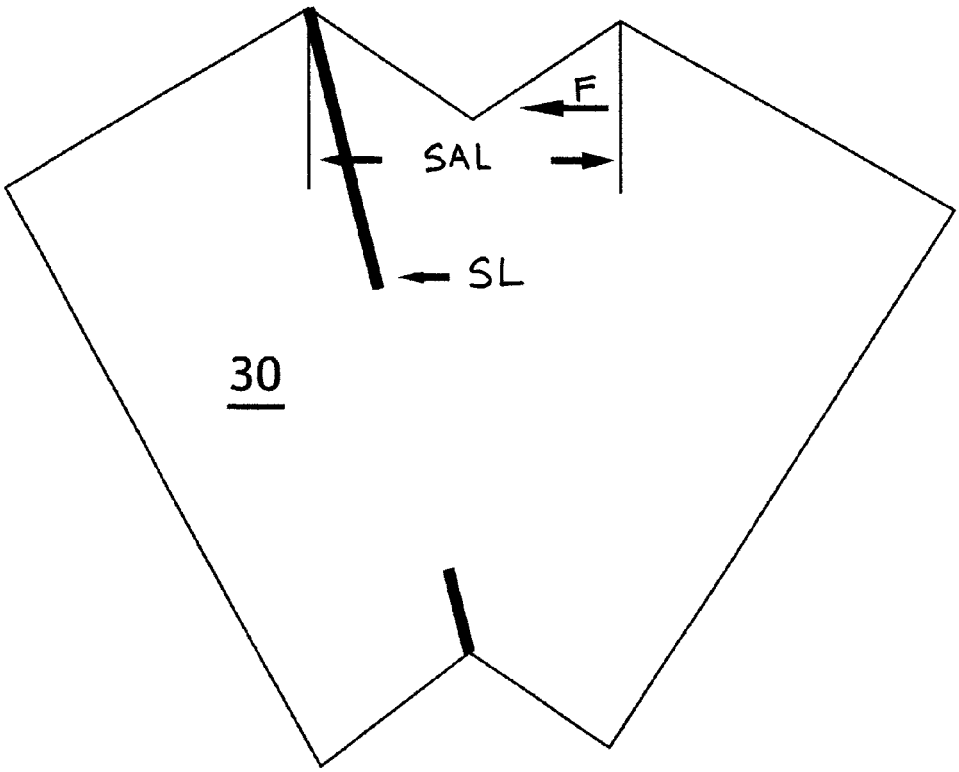
FIG. 1 is a plan view illustrating a template used in the cutting and sewing of protective cloth used in the construction of an intersection-space fire-barrier in accordance with the teachings of this invention so as to produce a protective cloth to accommodate an expansion-joint that comprises a corner junction without having excess cloth bulk or causing tearing of the cloth.

Angled, as used herein, refers to acute, obtuse, right-angled, and nearly, or approximately right-angled. The term "angled" is used herein mostly to refer to the configuration formed when architectural expansion-joints (which may be referred to as spaces), building units, or extensions (or as referred to as "arms") of fire-barriers intersect or meet at a common place.

Intumescent, as used herein, refers to those materials having properties that cause that material to expand when heated.

Insulation blanket, as used herein, refers to any number of insulator materials, including fiber blankets made from alumina, zirconia, and silica spun ceramic fibers, fiberglass, and the like.

High-temperature thread, as used herein, refers to any thread that is fire resistant or any thread that will not support combustion, such as a ceramic thread.

Intersecting architectural expansion-joints, as used herein, refers to any space that is formed by the spaced-convergence of more than two structural units, such as the spaced-convergence of three wall units or two walls and a floor unit. Such joints have also been referred to as intersection-space and multi-directional expansion joints.

Intersecting-Space Fire-Barrier, as used herein, refers to any fire-barrier that is shaped to functionally fit into an accepting intersection-space expansion-joint and is alternatively, referred to as a multi-directional and/or intersection-space fire barrier. Such fire-barriers are sized and shaped for installation into accepting intersection-spaces formed by the intersection of at least two expansion-joint spaces that each occur between different sets of adjacent spaced structural building units, each of said expansion-joint spaces defined by a plane, said plane defined by a set of three non-colinear points with each point defined by a set of x, y, z coordinates from the same coordinate system with no two of said coordinate sets being identical.

Intersection-space or intersecting-space, as used herein, refers to any expansion-joint-spaces that are formed by the intersection of at least two expansion-joint spaces that each occur between different sets of adjacent spaced structural building units, each of said expansion-joint spaces defined by a plane, said plane defined by a set of three non-colinear points with each point defined by a set of x, y, z coordinates from the same coordinate system with no two of said coordinate sets being identical.

Protective Cloth, as used herein, refers to a flexible, strong, protective, fire-resistant material that is designed to mechanically support the insulation material and to protect the insulation material from mechanical damage, as the insulation is mechanically weak and can be easily damaged by tearing or ripping either accidentally or intentionally during or after installation thus largely compromising the integrity of the fire-barrier. The fire resistant layers, such as a layer of insulation material together with a layer of intumescent material, can freely move with respect to the one or more protective layers or they may be attached together via threads or other attaching means. Protective cloths may be manufactured from continuous filament amorphous silica yarns, polymeric material, fiber reinforced polymeric material, high-temperature resistant woven textiles, or a metalized, fiberglass cloth. Metalized cloth may include fibers of stainless steel, aluminum, or copper, for example. Protective materials may also include metal foils or metal screens.

Seaming as used herein refers to connecting one part to another part, for example where a cloth is folded and the two parts of the cloth that have been brought together by the folding are subsequently "seamed" together along a predetermined line. The seaming may utilize stitching, using an adhesive, stapling, pinning, or any other means that will connect the two parts to each other.

Stripping, as used herein, refers to off-the-shelf non-flammable stripping used in construction and fabrication for holding, binding, and/or attaching.

Structural unit as used herein refers to structural building unit constructs such as walls, floors, ceilings, or the like.

Tri-dimensional or tri-directional as used herein refers to either an expansion-joint that has three member parts, such as a "T"-shaped expansion-joint where the "T"-joint is made up of three co-joint-arms or to a fire-barrier that is functionally shaped to accommodate a "T"-shaped joint.

Tetra-dimensional or tri-directional, as used herein, refers to either an expansion-joint that has four member parts, such as a cross-shaped expansion-joint where the cross-joint is made up of four co-joint-arms or to a fire-barrier that is functionally shaped to accommodate a cross-shaped joint.

Vertical/horizontal fire-barrier, as used herein, refers to a unitary structure fire-barrier comprising one vertical arm and one horizontal arm, which structure provides for the barrier to fit, as a one-piece drop-in unit, into an expansion-joint space defined by the 90° intersection of two expansion-joints, one vertical joint and one horizontal joint.

A LIST OF THE REFERENCE NUMBERS AND RELATED PARTS OF THE INVENTION

20 Intumescent strip material.
22 High-temperature thread.
30 Protective cloth.
32 Protective cloth flange.
40 First insulation blanket.
42 Second insulation blanket.
44 T-flap support.
90 Building unit.
100 T-shaped fire-barrier.
110 Vertical/Horizontal L-shaped fire-barrier.
120 Combination vertical/horizontal-L shaped and T-shaped fire-barrier.
4WF Four way flap.
4WFS Four way flap support.
CL Cut line.
F Fold.
FL Fold line.
FO Fold out.
FIL Fold in line.
FOL Fold out line.
FS Fold and stitch line.
OPW Optional pins and washers.
S Stitching
PC Protective cloth.
SAL Sewing alignment line.
SL Sew line.
SW Side wall.
T T-flap.
TSJS T-shaped expansion-joint-space.
RAHJS Right angle horizontal expansion-joint-space.
CSJS Cross-shaped expansion-joint-space.

It should be understood that the drawings are not necessarily to scale. In certain instances, details which are not necessary for an understanding of the present invention or which render other details difficult to perceive may have been omitted. It should be understood, of course, that the invention is not limited to the particular versions illustrated herein, but encompasses many embodiments, such as those that are discussed throughout the specification. Intersection-spaces that are formed when expansion-joint space intersect occur in many configurations, as all of those configurations entail various combinations of vertical, horizontal, and corner joints, it will be appreciated that all of the configurations are embodied by this invention.

DETAILED DESCRIPTION

Referring now particularly to the drawings which show views of exemplary versions of some of the templates that are contemplated by this invention. The drawings also illustrate how the above mentioned disadvantages have been overcome. It should be noted that the disclosed invention is disposed to versions in various sizes, shapes, contents, and forms. Therefore, the versions described herein are provided with the understanding that the present disclosure is intended as illustrative and is not intended to limit the invention to the versions described herein.

The multi-layered, fire-barriers manufactured according to the principles of the present invention are each sized and shaped for installation into accepting intersection-spaces formed by the intersection of at least two expansion-joint spaces that occur between two adjacent spaced structural building units, each of said expansion-joint spaces defined by a plane, said plane defined by a set of three non-colinear points with each point defined by a set of x, y, z coordinates from the same coordinate system with no two of said coordinate sets being identical. The fire-barriers are shaped for use in two-way planar, L-shaped expansion-joint spaces, T-shaped, cross-shaped, V-shaped, and vertical/horizontal L-shaped corner intersection spaces, for example, and may comprise at least one layer of: protective cloth, insulating blanket, intumescent material, and mechanically supporting layer, for example. The barriers prohibit the movement of fire, heat, or smoke through the flue-like channels created by the expansion-joints of a structure are provided ready to install in a one-step, drop-in process.

Fire-barriers are often, but not necessarily, constructed of three-layers; a protective cloth layer, a thick insulation layer, and a layer containing intumescent material. The protective cloth prevents the more susceptible insulation blanket from suffering physical damage, such as tearing. One preferred method of constructing the intersection-space fire-barriers of this invention is to use the three-layer construction method, although it should be understood that many other methods and materials may also be used.

Many variations of structural intersection-space expansion-joints exist. FIG. 20 provides schematic drawings of four examples; an intersection-space created by the intersection of two wall units, a T-shaped intersection-space formed by the intersection of three wall units, a 90° horizontal intersection space, created by the intersection of two corner wall units, and a cross-shaped intersection space created by the intersection of four corner wall units. The manufacture and the structure of intersection-space fire-barriers, according to the principles of the present invention, are described below along with others.

The construction of the three-layered L-shaped fire-barrier, in this example, begins with preparation of the protective cloth layer 30 by cutting the protective cloth to shape according to the template illustrated in FIG. 1, folding the cloth in the direction given by the F (fold) arrow along the fold lines SAL, and then stitching the cloth along the "sew line" SL. This assembly method produces a protective cloth jacket that fits neatly into a 90° corner intersection-space without tearing the cloth. Protective cloth, although strong and somewhat flexible, is often rigid enough to be prone to tearing when stressed by bending, such as by being forced to achieve a corner shape. Additionally, if the relatively thick protective cloth is folded to fit a corner without first shaping the cloth, as taught herein, an unacceptable bulky product will be produced. However, when the protective cloth is cut, folded, and seamed according to the pattern provided by the principles of this invention a custom-shaped intersection-space, horizontal, L-shaped fire-barrier without excess bulk is produced. Moreover, this unique method of shaping the protective cloth of the barrier eliminates the stresses on and potential for tearing of the protective cloth in the future, such during transport and installation. The protective cloth may be seamed by stitching using a high-temperature thread, such as filamentous fused silica, for example. The L-shaped protective cloth cut, folded, and sewn according to this method is now ready to be used in the construction of a 90° intersection-space fire-barrier. The protective cloth part, thus shaped, will be referred to as the first part of the horizontal L-shaped barrier.

Figure 2:
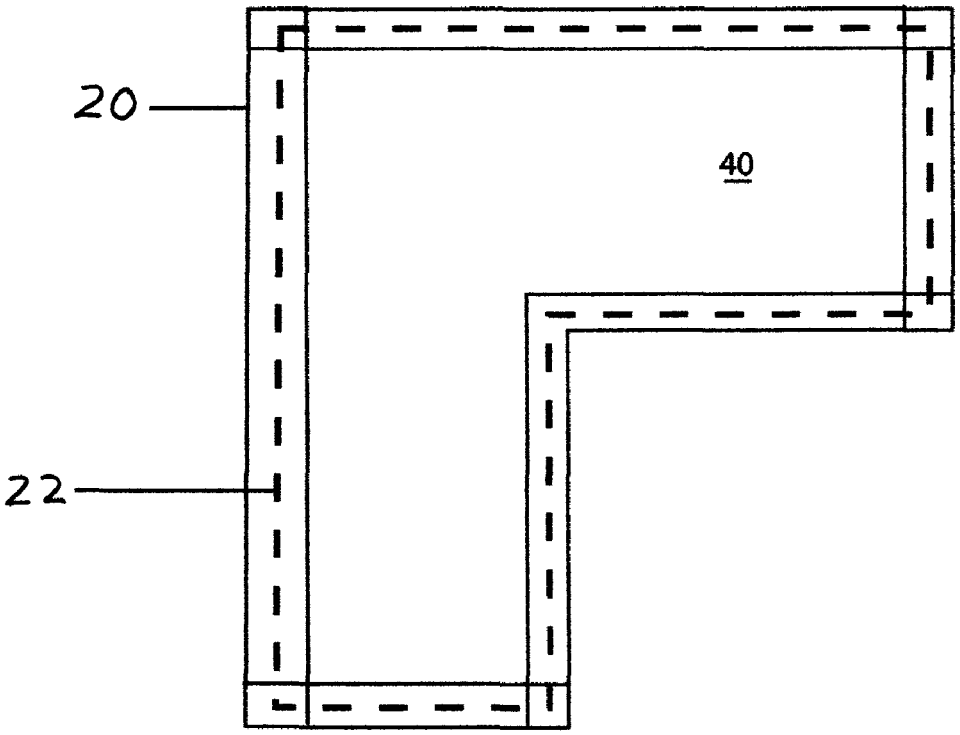
FIG. 2 is a plan view looking down on an insulation blanket layer of an intersection-space fire-barrier to be fitted into the protective cloth that has been folded and seamed for installation into a 90° angled intersection-space.

The second part of the L-shaped barrier as shown in FIG. 2, comprises the other two layers of the three-layer construction. In this example, intumescent material 20 strip-layers are positioned on insulation blanket layer 40, as shown. The two layers may be connected by stitching using high-temperature thread 22 at this point or they may be stitched together with the protective cloth after the following step.

Figure 3:
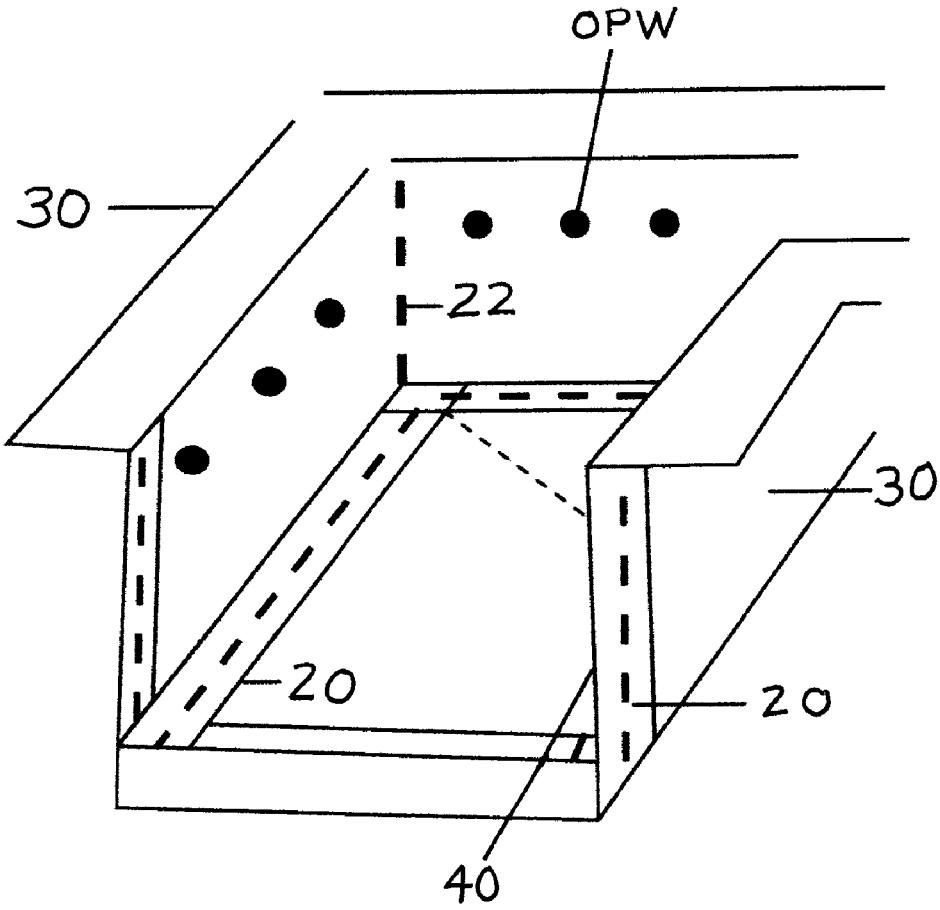
FIG. 3 is a perspective view looking down on and into an intersection-space fire-barrier ready for installation in a 90° angled intersection-space.

FIG. 3 is a perspective view looking down on and into a intersection-space fire-barrier shaped and ready to be installed in a 90° intersection-space. As can be seen, the insulation blanket and the intumescent strips, as shown in FIG. 2 have been placed on the L-shaped protective blanket. The three-layers are affixed together by sewing or by any other desired fixation means, such as by stapling or by using pins and washers OPW as illustrated in FIG. 3. As can be seen, the more easily damaged insulation blanket and the intumescent strips are supported and protected by the shaped layer of protective cloth. The intumescent material, which expands when a predetermined temperature is reached, is functionally positioned to provide the maximum amount of protection against the penetration of heat, flame, or smoke. The intumescent expansion prevents the passage of heat, flame, or smoke though openings that may have existed before being blocked by the swollen intumescent.

Figure 4:
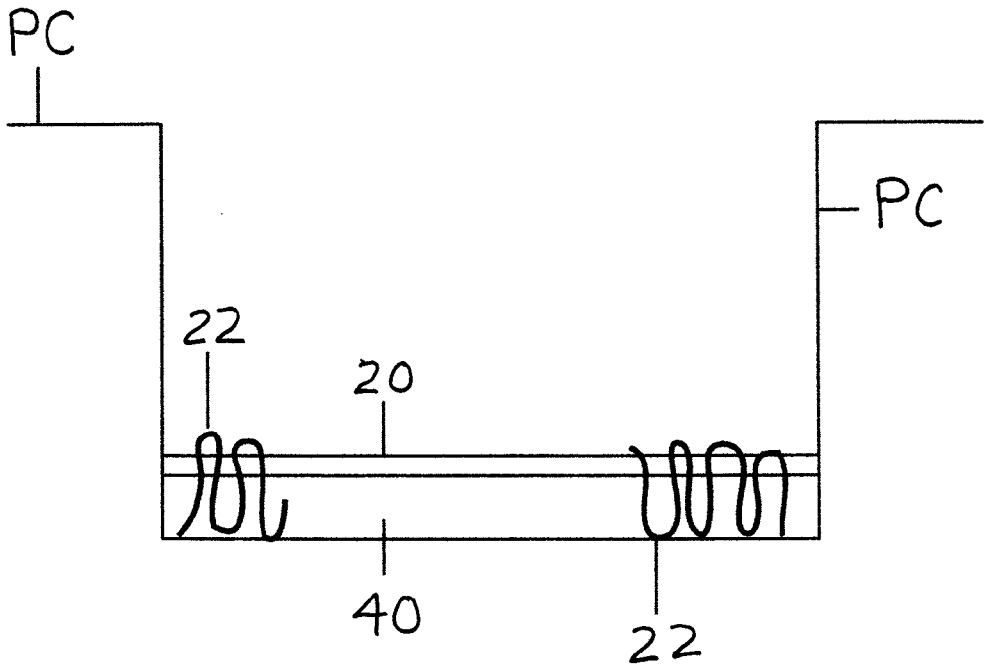
FIG. 4 is a cross-sectional view of a multi-dimension fire-barrier the layers may be connected using a stitching method.

As is shown in FIG. 4, the stitching S that attaches the intumescent material to the blanket goes through the intumescent strip layers, the blanket, and the protective cloth, so that all three-layers are attached together to provide a unitary functional intersection-space fire-barrier. Once the L-shaped fire-barrier is situated in a 90° intersection-space it is attached to the structural unit in any one of a variety of ways, such as by riveting the fold-out attachment flange portions of the protective blanket (as shown in FIG. 3, for example) to the top of the structure.

Figure 5:
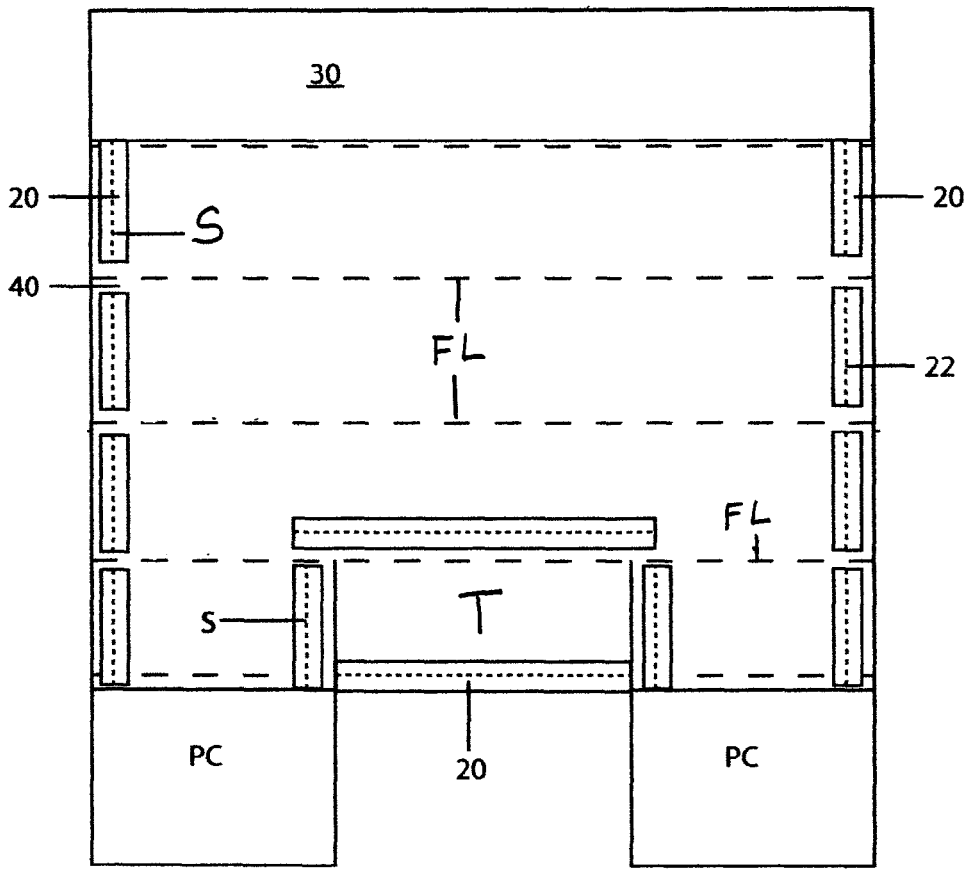
FIG. 5 is a plan view looking down onto unfolded Part 1 (i.e., the base-part) of an intersection-space fire-barrier to be installed into a "T" shaped intersection-space.
Figure 6:
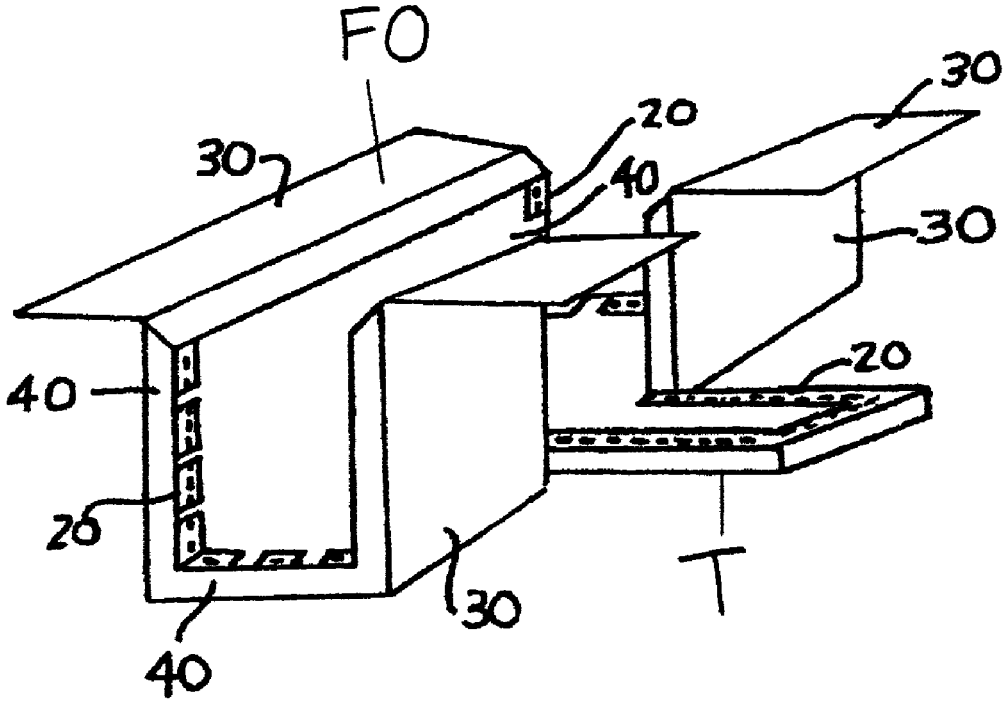
FIG. 6 is a perspective view of folded Part 1 as shown in FIG. 5.
Figure 7:
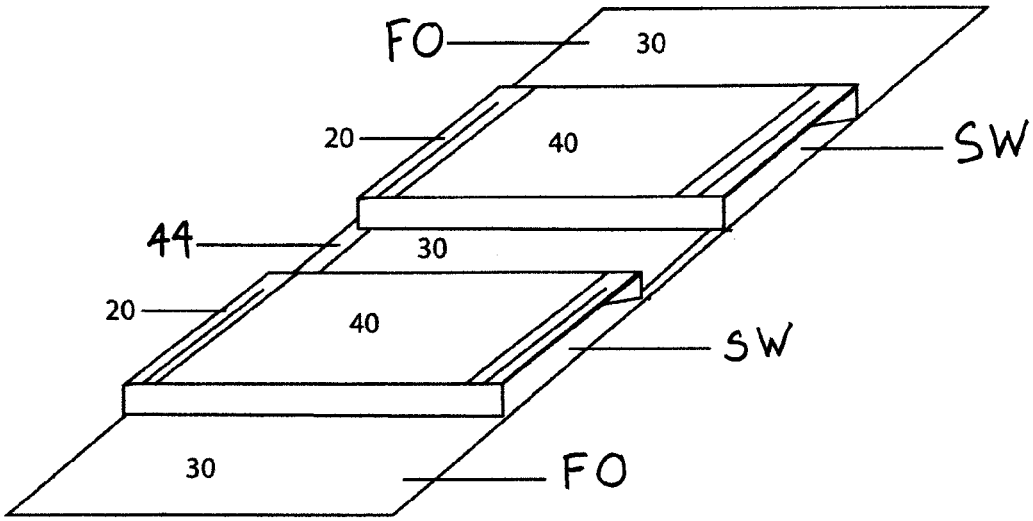
FIG. 7 is a perspective view of unfolded Part 2 of the intersection-space fire-barrier to be installed in a "T" shaped intersection-space.

Another intersection-space configuration that occurs frequently is the T-shaped intersection-space that occurs when three structures intersect, such as the spaced-convergence of three walls. FIG. 5 shows the base part of a custom sized and styled T-shaped intersection-space fire-barrier. Also shown in FIG. 5 is the three-layer construction that was used in the L-shaped fire-barrier. It must again be pointed out, however, that other materials and other constructions may be used in the manufacture of a fire-barrier. The novelty of this invention resides mainly in providing intersection-space fire-barrier structures regardless of the materials used to make the structures, and in teaching the methods of making the custom-fit and custom-sized intersection-space fire-barriers, where the fire-barriers are produced as ready to install one-piece units, or if desired, may be provided unassembled to be assembled on-site. As shown in FIG. 5, strips of intumescent material 20 are functionally positioned on the surface of insulation blanket 40, which in turn is functionally positioned on protective cloth 30. Intumescent layer 20, insulation blanket 40, and protective cloth 30 are fixedly attached together to form an integral unit. In this example, the fixation is accomplished by stitching, as was shown in FIG. 4, using a high-temperature thread 22, although the fixation may be accomplished by any other fixation means, including staples and adhesive, for example. To prepare unfolded Part 1, which is shown in FIG. 5, (i.e., the base of the barrier), the entire part that is illustrated in FIG. 5, for its union with Part 2 (i.e., the attachment part) as illustrated in FIG. 7, the top and bottom end of Part 1 are folded toward each other about the two of the fold lines shown in FIG. 5. Shown situated on each side of the "T" flap of the base, FIG. 5, are two extensions of insulator blanket 40. The inner edges of the two extensions of the insulator blanket, that is, the edges that border each side of the "T" flap, are constructed to be physically separate from the "T" flap (i.e., cut loose from the "T" flap) so that the "T" flap can be maintained in its folded out position while the two insulator blanket extensions along with the protective cloth extensions are folded up, as is shown in FIG. 6.

FIG. 7 is a plan view looking down onto an unfolded second part (the attachment part) of a T-shaped intersection-space fire-barrier. To prepare Part 2 (the attachment part) for connection to Part 1 (the base section), the two side walls of Part 2 are folded up towards each other at the fold lines shown in the figure. Once this is accomplished, Part 2 is positioned so that the "T" flap support part of the base part is placed under the "T" flap of the attachment part. With Part 2 (the attachment part) so positioned, the folded-up side walls SW of Part 2 (the base part) provide side walls for the "T" flap extension of the T-shaped intersection-space fire-barrier. Finally, the fold-out flange-attachment portions FO are folded out to be used for attaching the intersection-space fire-barrier to the building units that form the intersection space.

Figure 7A:
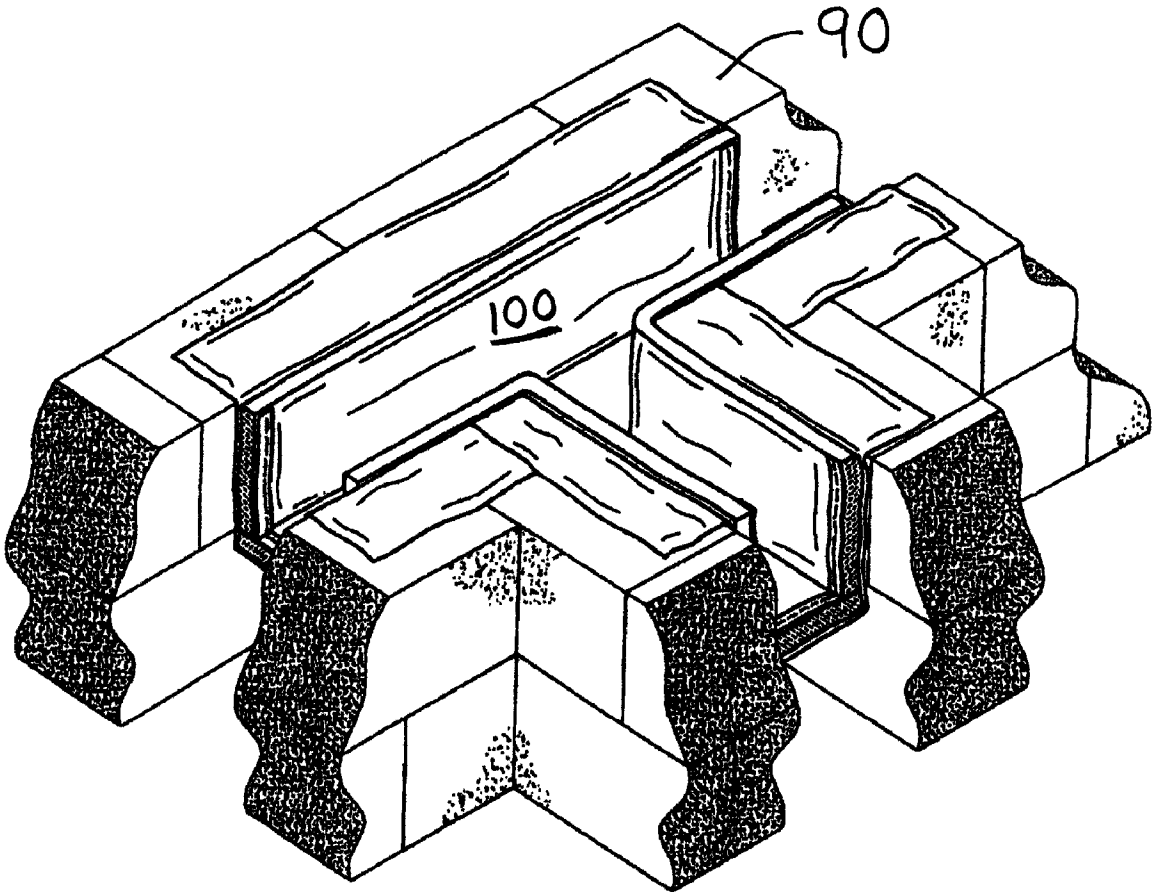
FIG. 7*a* is a perspective view of the "T" shaped intersection-space fire-barrier ready for installation.

FIG. 7*a*, a perspective view of the "T" shaped intersection-space fire-barrier positioned within the intersection-space, illustrates a completely fabricated intersection-space fire-barrier with, in this example, the addition of protective metal screening. The intersection-space fire-barrier is manufactured off-site and is shipped directly to the construction site to be positioned, in a one-step, often times one person step, in place. The barrier is permanently attached to each of the building units 90 bounding the intersection-space by any effective attachment means, such as by the use of rivets. The figure shows the use of clamps as the means to attach the barrier to the model expansion structure.

Another common intersection-space expansion-joint configuration is that of the 4-way or cross-shaped intersection-space. This intersection-space occurs where four building units intersect, such as the spaced-convergence of four walls, for example. How to make a fire-barrier custom styled and sized for any 4-way intersection-space is shown in FIGS. 8-10.

Figure 8:
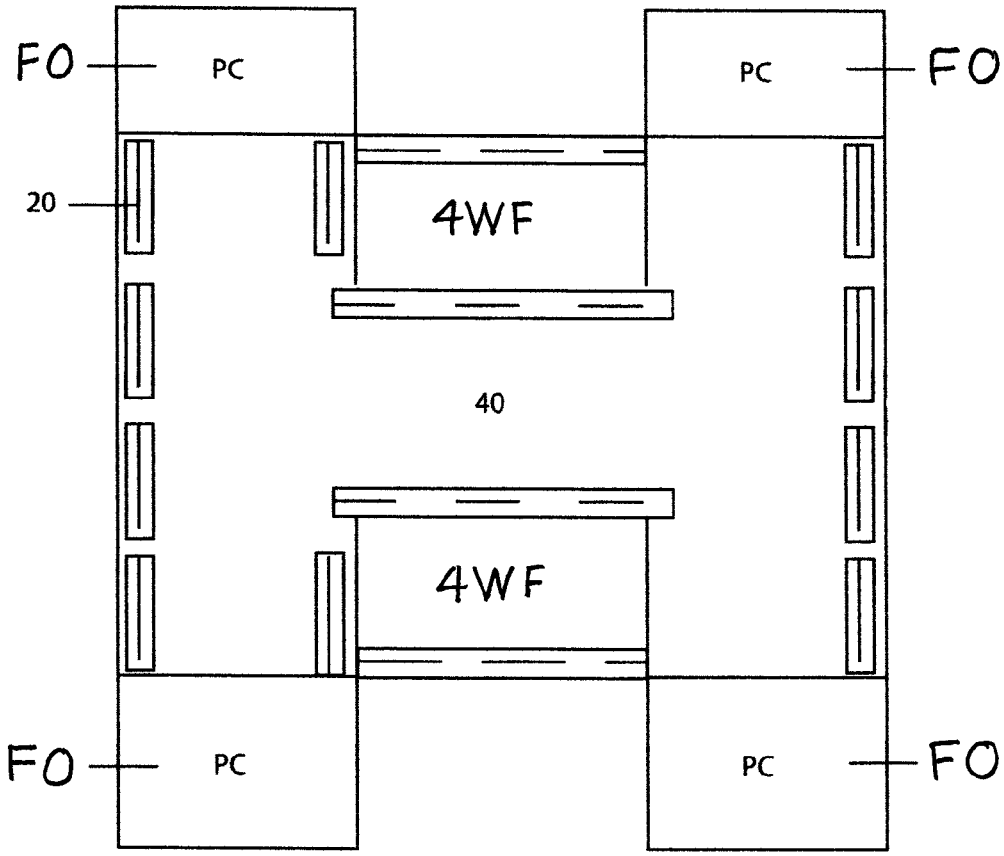
FIG. 8 is a plan view looking down onto the unfolded base-part of an intersection-space fire-barrier to be installed in a 4-way intersection-space.

FIG. 8 shows the base part of a 4-way intersection-space fire-barrier. As in the other examples, this example also employs three-layer construction, where the layers comprise an intumescent strip layer positioned on a layer of insulation material, which in turn is positioned on a layer of protective cloth. The three-layers are connected together by stitching (as shown in FIG. 4), where the stitching is accomplished using high-temperature thread. The design of the base part of the 4-way intersection-space fire-barrier uses the principals of the T-shaped intersection-space fire-barrier. In fact, the construct of the "T" flap end of the base part of the T-shaped intersection-space fire-barrier is simply followed on the two opposing ends of the base part of the 4-way fire-barrier instead of on only one end of the base as is done in the T-shaped fire-barrier.

Situated on each side of the two 4-way Flaps 4WF of the protective cloth base of the 4-way barrier are two extensions of insulator blanket 40. The inner edges of the two extensions of the insulator blanket, that is, the edges that border each side of the "T" flap, are constructed to be physically separate from the "T" flap, so that the "T" flap is kept open flat while the two insulator blanket extensions along with the protective cloth extensions (denoted PC) are folded up, as is shown in FIG. 9. The protective cloth extensions FO are subsequently folded out to form flanges to be used for attaching the fire-barrier to the structure parts of the expansion-joint.

Figure 9:
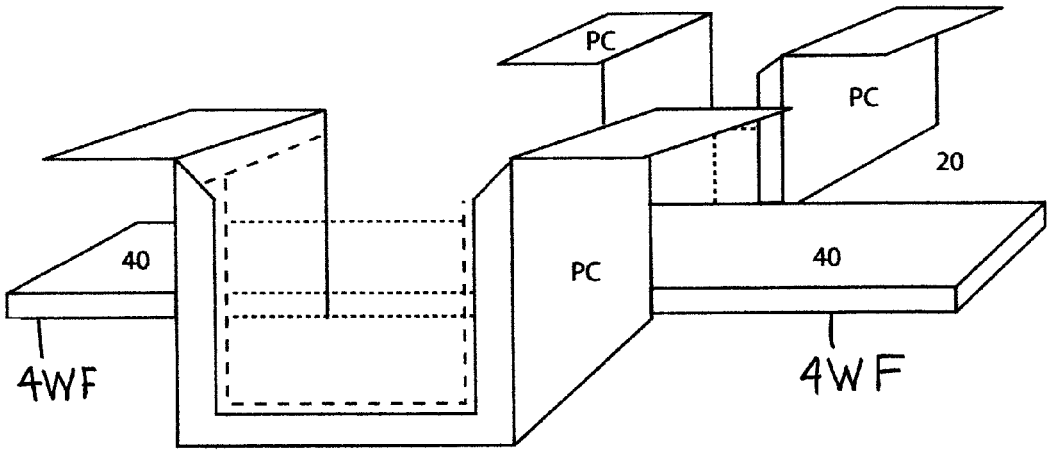
FIG. 9 is a perspective view of the folded base-part, as shown in FIG. 8.
Figure 10:
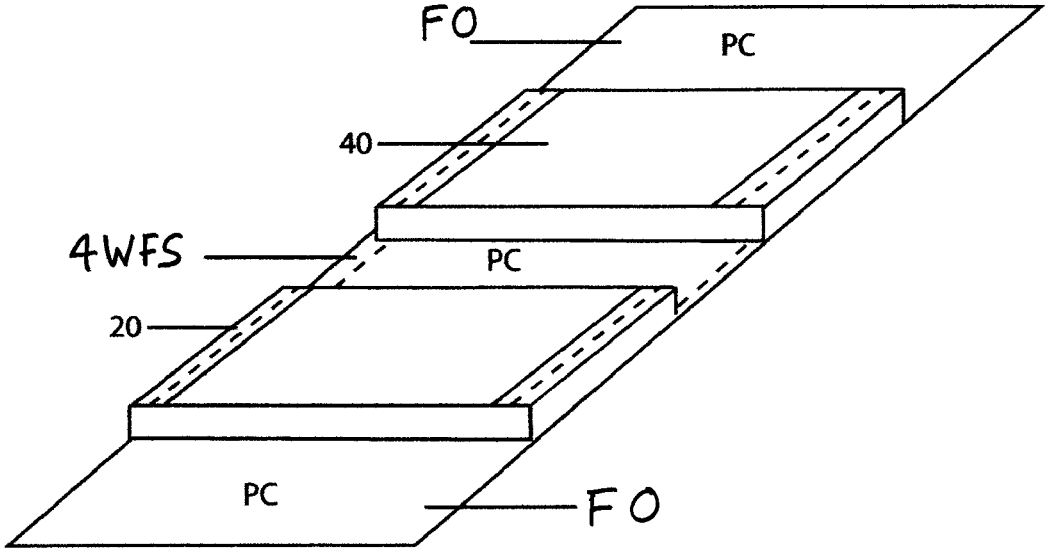
FIG. 10 is a perspective view of an unfolded second part of a 4-way intersection-space fire-barrier.

Shown in FIG. 9 is the 4-way base folded up and out ready for the addition of the attachment parts. Note that in the case of the 4-way intersection-space fire-barrier there are two attachment parts. FIG. 10 illustrates one attachment part. Only one attachment part is shown in FIG. 10 as the two attachment parts required in the construction of a 4-way fire-barrier are identical to each other and to the attachment part used in the T-shaped fire-barrier. As in the T-shaped fire-barrier, the "flap support" 4WFS parts of the attachment parts (Part 2 in the T-shaped fire-barrier) are each inserted beneath one of the two 4-way flaps. In this way, as in the previous example, insulator parts 20 then are in position to form the side barriers of the 4-way flap extensions. Once the two attachments are in position, as just described, the 4-way intersection-space fire-barrier is ready for installation in a 4-way extension joint.

Figure 11:
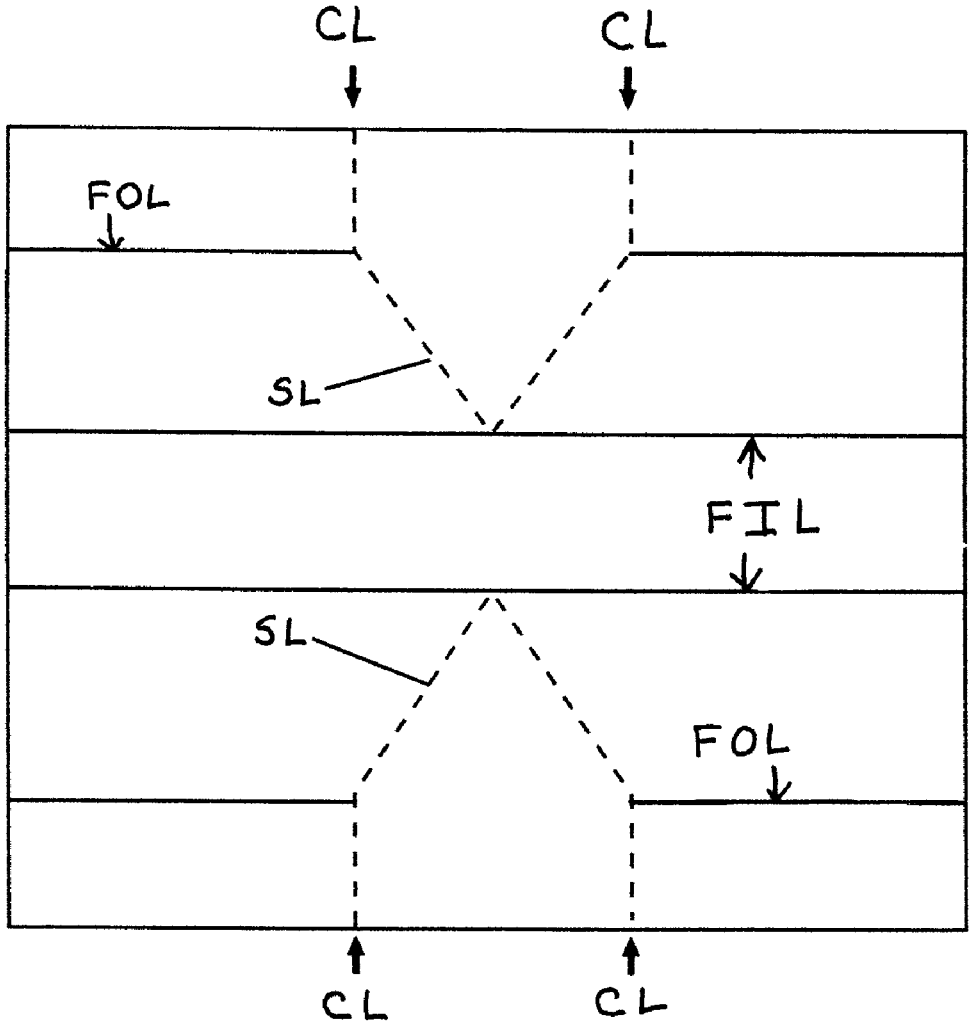
FIG. 11 is a plan view illustrating a template used in the cutting and sewing of the protective cloth used in the construction of a vertical/horizontal 90° intersection-space fire-barrier so as to comprise a barrier shaped in a vertical/horizontal 90° junction without having excess cloth bulk or causing tearing of the cloth.

FIG. 11 shows a plan view of a template used to cut and sew protective cloth to construct a vertical/horizontal 90° intersection-space fire-barrier to fit a vertical/horizontal 90° intersection-space without having excess cloth bulk or causing tearing of the cloth. The template teaches four cut lines CL. Once these cuts are made in the protective cloth shaped according to the template, the cloth is folded about the four fold-out lines FOL and two fold-in lines FIL. The cloth is also to be folded about the two pair of angled pattern lines SL and then seamed, such as by being sewn together, for example, using the pattern lines as a stitching guide. The cutting, folding, and sewing of the protective cloth, as just described, results in the cloth assuming a chair-like shape, where the chair has arm-like and wing-like extensions. These extensions will be used to attach the finalized intersection-space fire-barrier to the structures. As in the previous examples, if stitching is the connection means used, high temperature thread is employed.

Figure 12:
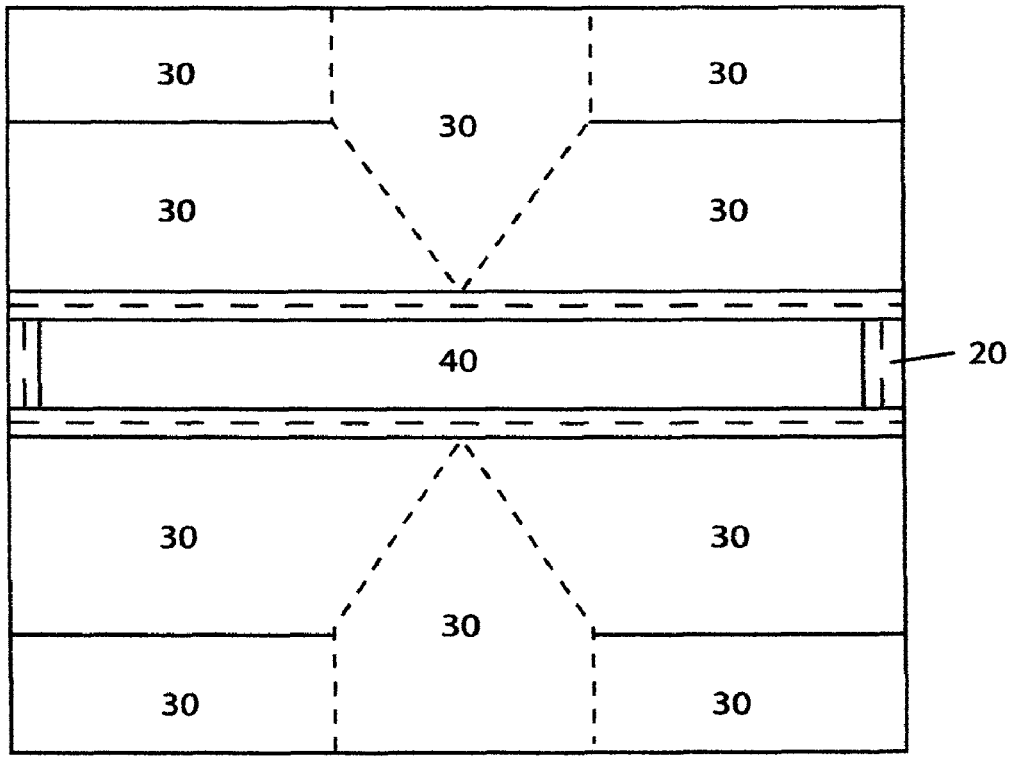
FIG. 12 is a plan view looking down onto a vertical/horizontal 90° intersection-space fire-barrier before it has been cut, folded, or stitched.

FIG. 12 is a plan view looking down onto protective cloth 30 patterned for cutting, folding, and seaming according to the vertical/horizontal 90° intersection-space fire-barrier template as illustrated in FIG. 11. In the designated (see FIG. 11) mid-area insulation blanket 40 has been positioned. Positioned on the edge surface area of the insulation blanket is intumescent stripping material 20. As in the previous examples, the three layers are connected together by stitching with high temperature thread.

Figure 13:
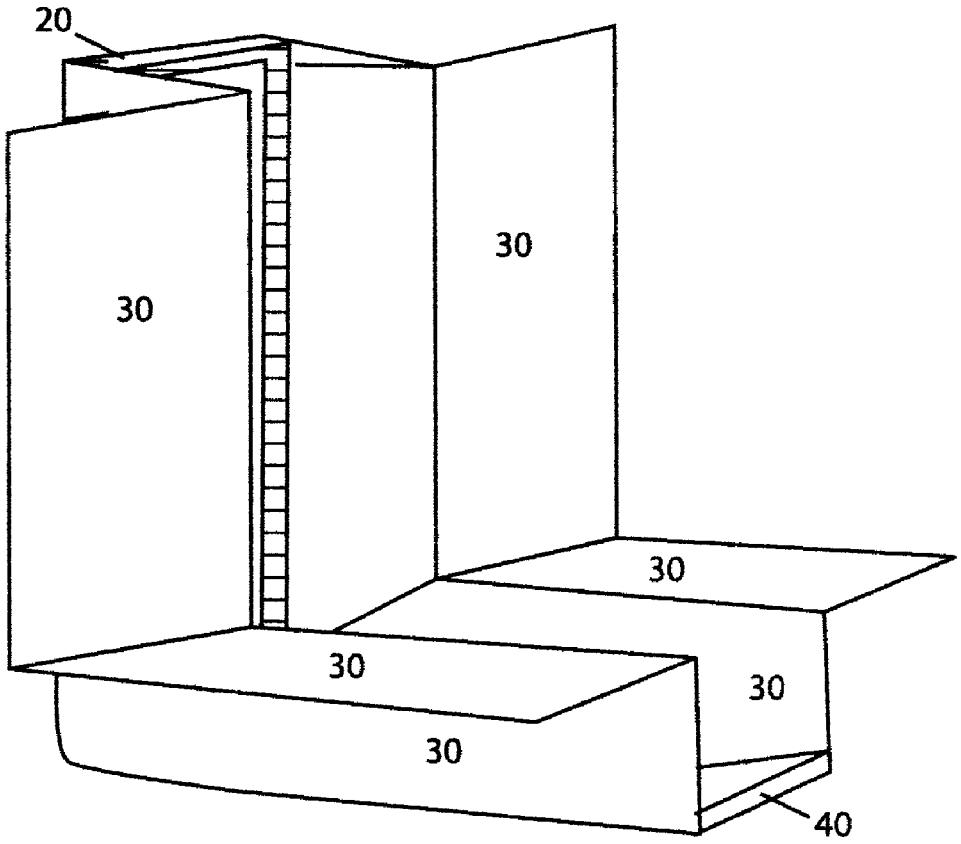
FIG. 13 is a perspective view of the vertical/horizontal 90° intersection-space fire-barrier, as shown in FIG. 12, prepared for installation.
Figure 13A:
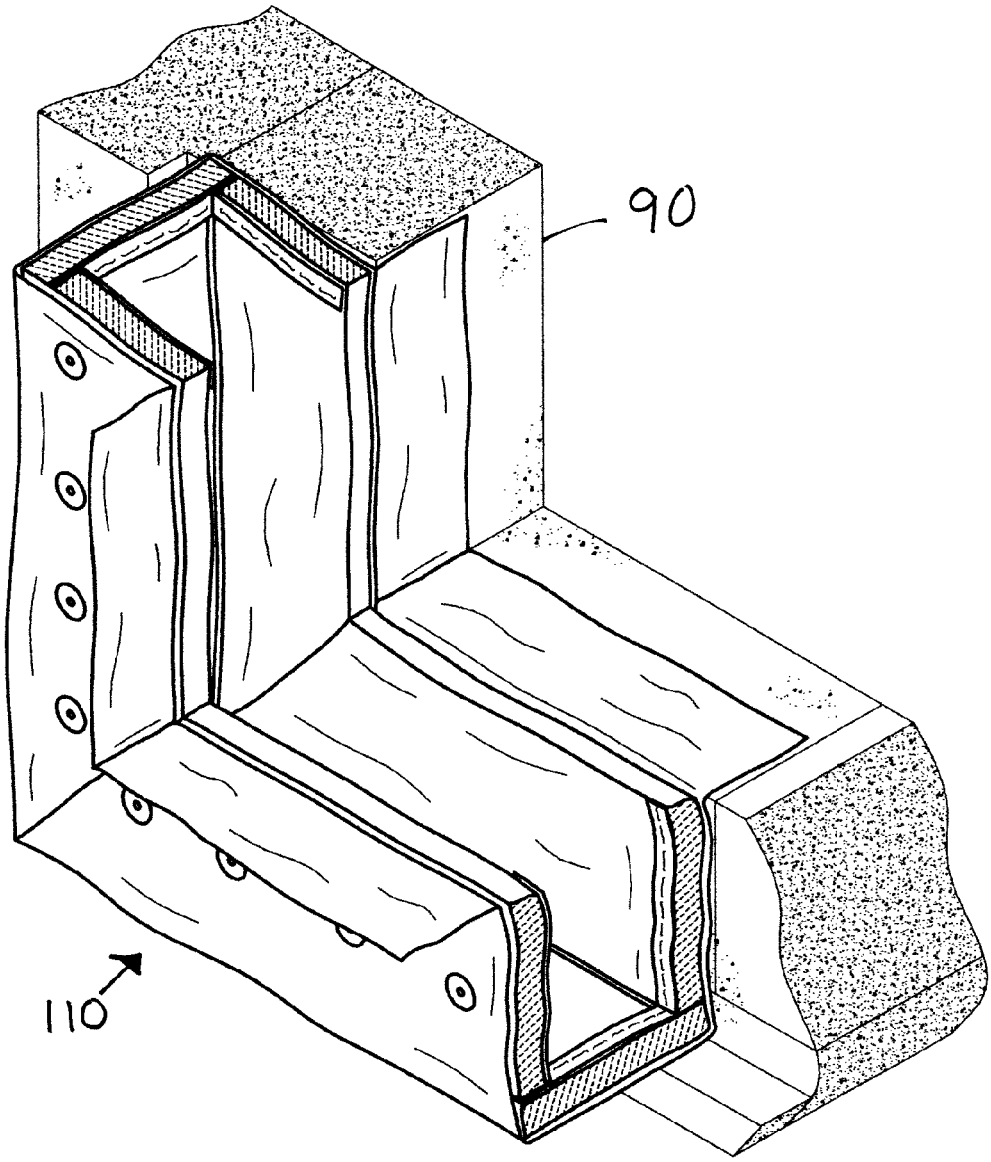
FIG. 13*a* is a perspective view of the vertical/horizontal 90° fire-barrier, as shown in FIG. 12.

FIG. 13, a perspective view, shows the cut, folded, and sewn vertical/horizontal 90° intersection-space fire-barrier 110 ready for installation into a vertical/horizontal 90° expansion-joint. FIG. 13*a* shows the intersection-space barrier seamed by the use of pins and bolts and positioned in a model vertical/horizontal 90° intersection-space. In will be appreciated, that in an actual structure the barrier is permanently installed onto building units 90 using any functional attachment means, such as rivets.

Figure 14:
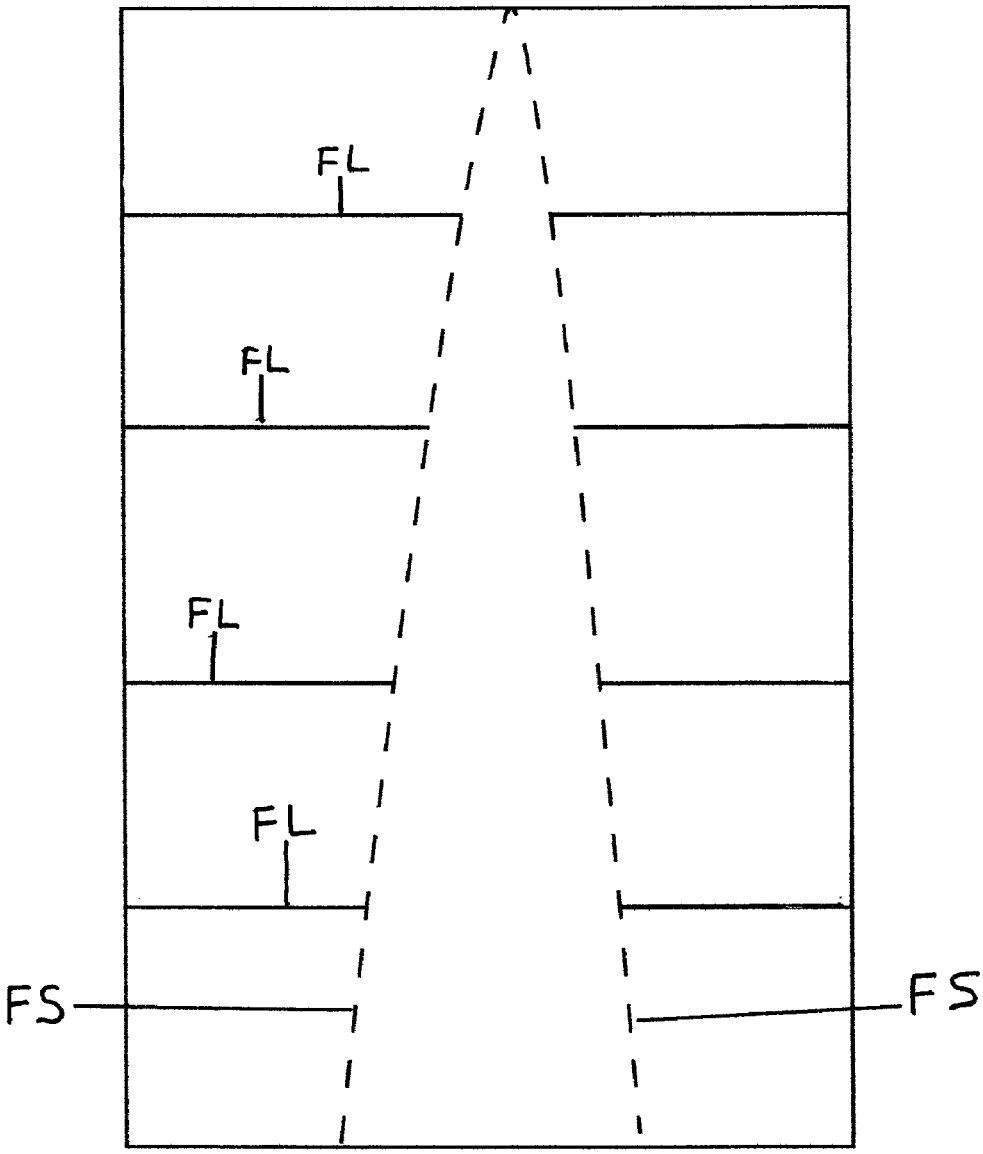
FIG. 14 is a plan view of a template used in the cutting and sewing of the protective cloth used in the construction of a horizontal 45° intersection-space fire-barrier so as to produce a cloth to fit into an intersection-space that comprises a horizontal 45° junction without having excess cloth bulk or causing tearing of the cloth.

FIG. 14 is a plan view of a template used in the folding and seaming of protective cloth used in the construction of a horizontal 45° intersection-space fire-barrier so as to produce a cloth to fit into an intersection-space that comprises a horizontal 45° junction without having excess cloth bulk or causing tearing of the cloth. Cutting is not required to achieve the horizontal 45° intersection-space fire-barrier. In this example, the protective cloth, once cut to conform to the template, as shown, is folded along the outer set of fold lines FL and seamed along stitch lines FS and then folded up along the inner set of the fold lines and folded out along the outer set of fold lines. At this point, the protective blanket is ready for the addition of a layer of insulation blanket and a layer of intumescent material.

Figure 15:
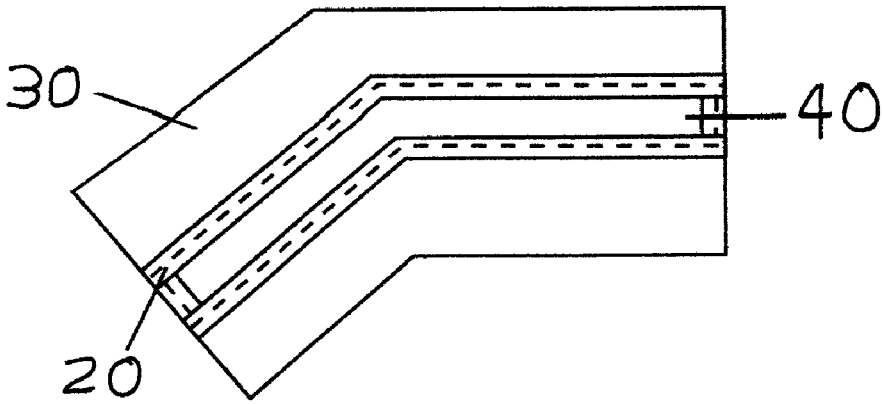
FIG. 15 is a plan view looking down onto a horizontal 45° intersection-space fire-barrier prepared for installation.

FIG. 15 is a plan view looking down onto a horizontal 45° intersection-space fire-barrier with attached layers of insulation blanket and intumescent material ready for installation in a horizontal 45° intersection-space.

Figure 16:
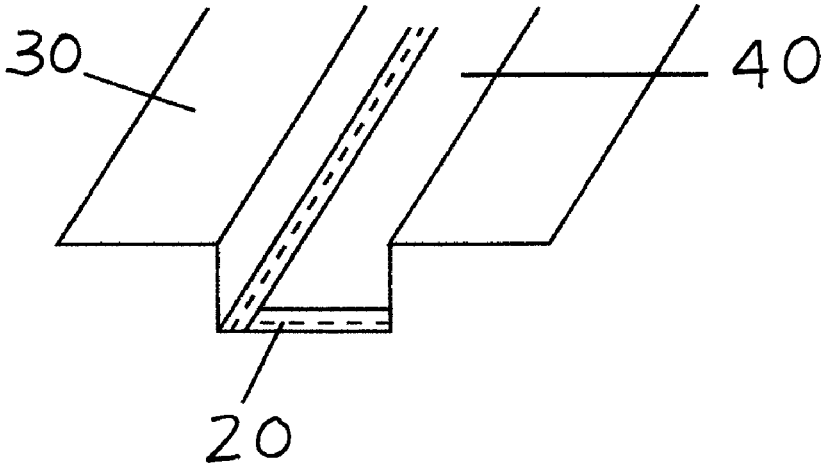
FIG. 16 is a perspective view of part of the horizontal 45° intersection-space fire-barrier, as shown in FIG. 15, ready to be installed.

FIG. 16 is a perspective view of one end of the horizontal 45° intersection-space fire-barrier, as shown in FIG. 15, ready to be installed.

Figure 17:
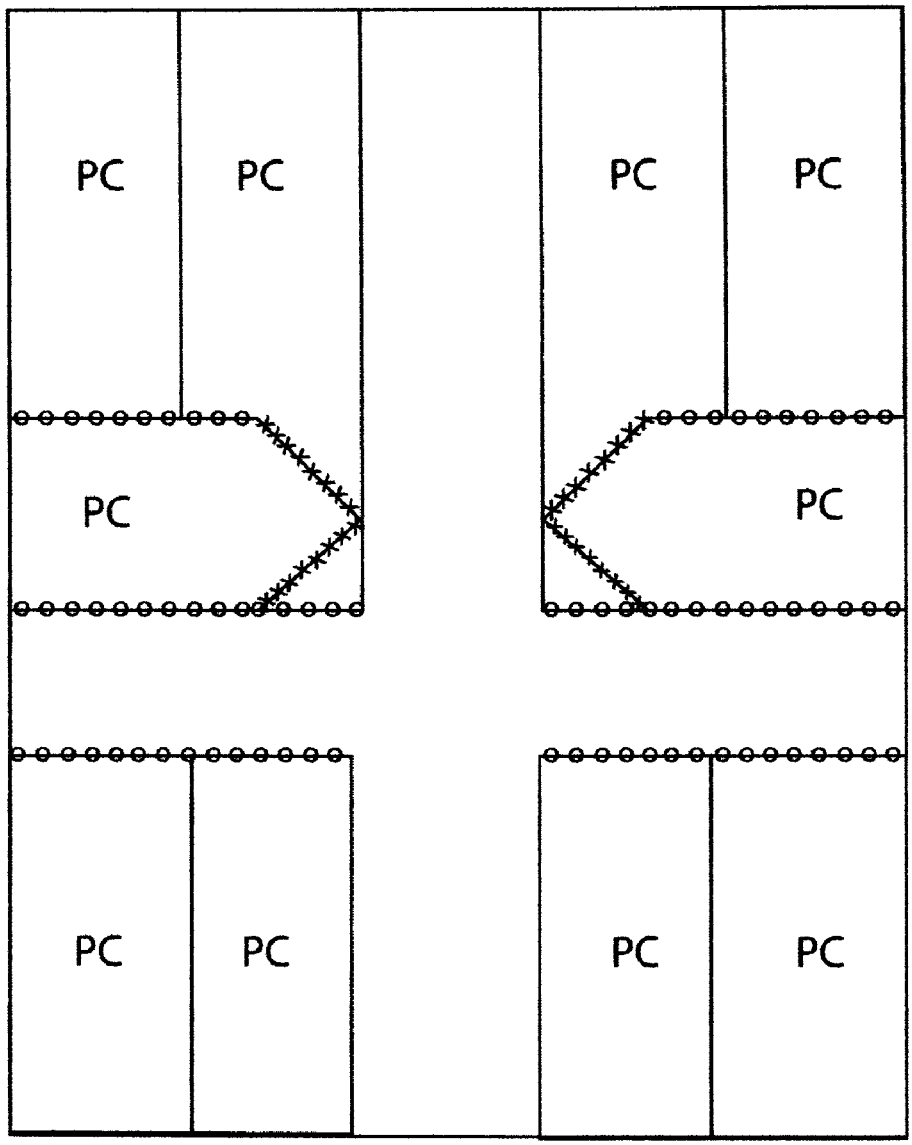
FIG. 17 is a plan view of a template used in the cutting and sewing of the protective cloth used in the construction of a horizontal T-joint/vertical intersection-space fire-barrier so as to produce a cloth to fit around a horizontal T-joint/vertical intersection-space without having excess cloth bulk or causing tearing of the cloth.
Figure 18:
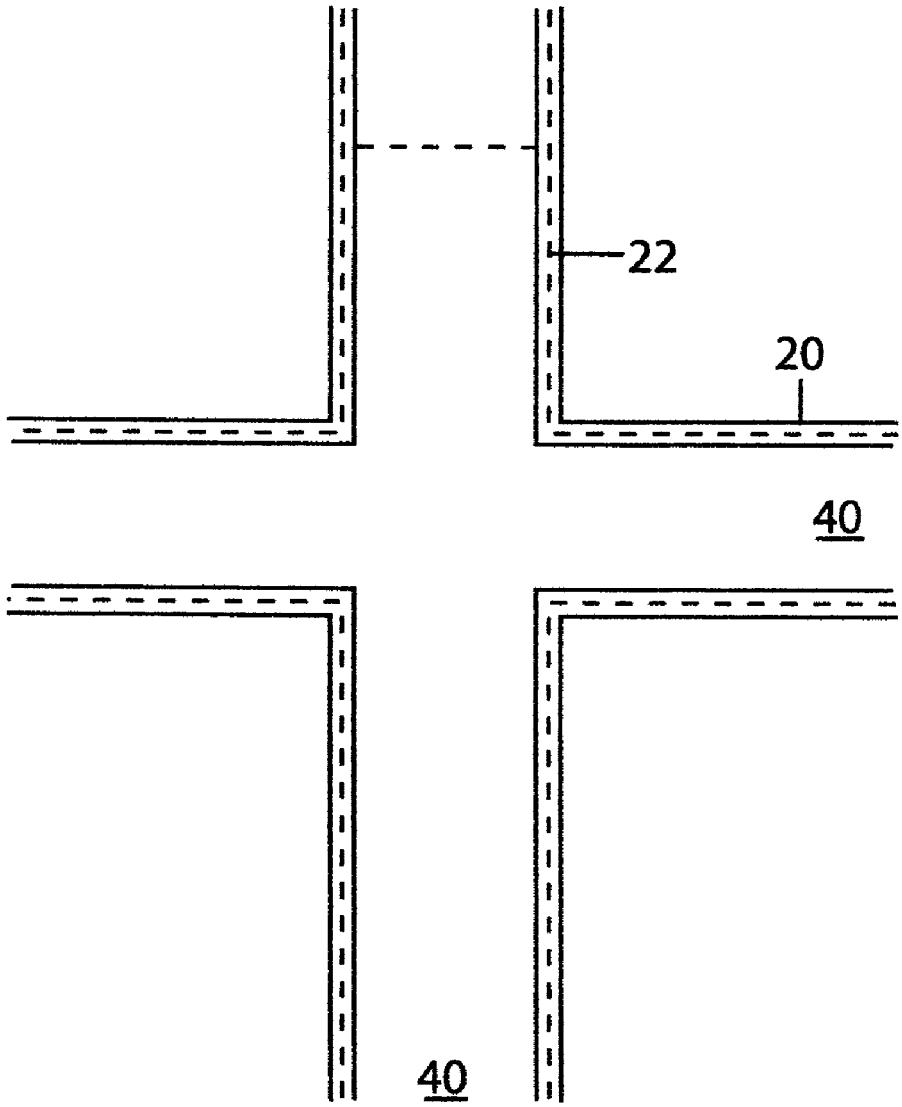
FIG. 18 is a plan view looking down onto an unfolded insulation blanket with intumescent material positioned on the insulation blanket ready for fitting into a protective cloth cut and sewn to fit into a vertical/horizontal "T" intersection-space.

FIG. 17 is a plan view of a template used in the cutting, folding, and sewing of the protective cloth used in the construction of a horizontal T-joint/vertical intersection-space fire-barrier so as to produce a cloth to fit around a horizontal T-joint/vertical intersection-space without having excess cloth bulk or causing tearing of the cloth. The lines that are to be used as cutting guides, are Illustrated in FIG. 17, as the lines marked with circles, whereas the lines that to be used as the pattern for folding and seaming are the lines marked with "X"s. The plain lines are guides for folding only. As seen in the figure, there is a cross-shaped area on which a suitable shaped insulation blanket is to be placed. Once the cloth has been cut, folded, and seamed according to the template as illustrated in FIG. 17, FIG. 18 is a plan view looking down onto an unfolded, but cross-shaped insulation blanket with intumescent material positioned on the insulation blanket layer. These two layers are ready for fitting into a protective cloth cut and sewn following the horizontal T-joint/vertical fire-barrier template as illustrated in FIG. 17.

Figure 18A:
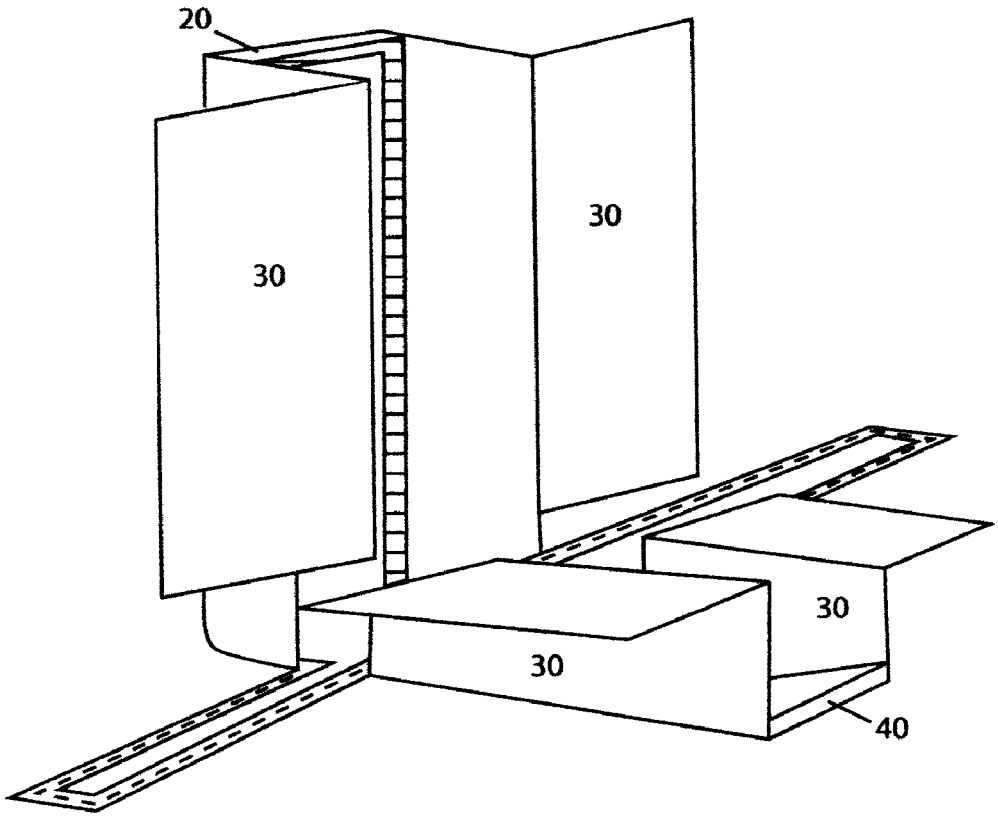
FIG. 18*a* is a perspective view of the cut, folded, and seamed fire-barrier sized and shaped to fit a vertical/horizontal T-shaped intersection-space with the insulation blanket and intumescent material, as shown in FIG. 18 positioned in the cut, folded, and seamed intersection-space fire-barrier.
Figure 18B:
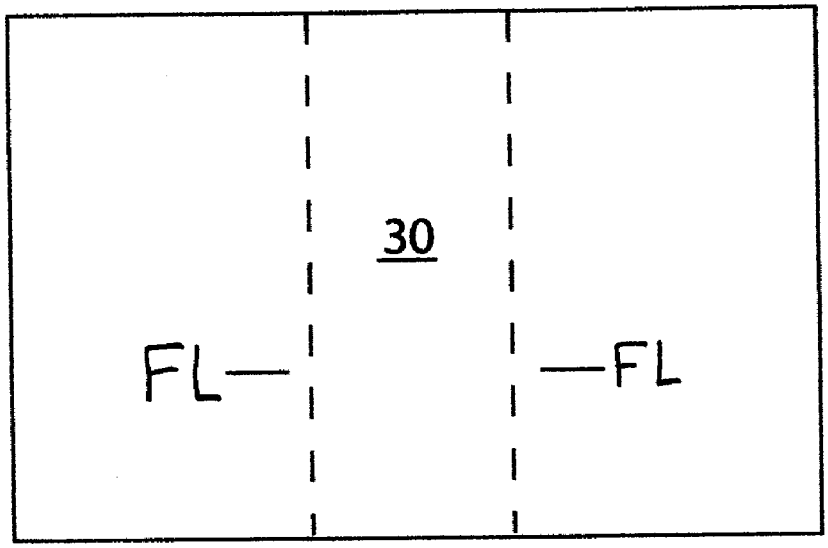
FIG. 18*b* is a plan view of the template that is used to cut the protective cloth that is to be positioned under and about the T-shaped extension arms as illustrated in FIG. 18*a*.

FIG. 18*a*, a perspective view of the cut, folded, and seamed intersection-space fire-barrier sized and shaped to fit a horizontal T-joint/vertical intersection-space with the insulation blanket and intumescent material, as shown in FIG. 18 positioned in the cut, folded, and seamed fire-barrier, shows the partially assembled barrier ready for the protective cloth, cut according to the template illustrated in FIG. 18*b*, to be positioned under and about the T-shaped extensions.

FIG. 18*b* is a plan view of the template that is used to cut the two pieces of protective cloth, where each piece is to be positioned under and about the extended T-shaped extension arms, as illustrated in FIG. 18*a*. This addition provides a protective and supportive layer to hold the insulation blanket/intumescent material layers that are to be installed next.

Figure 19:
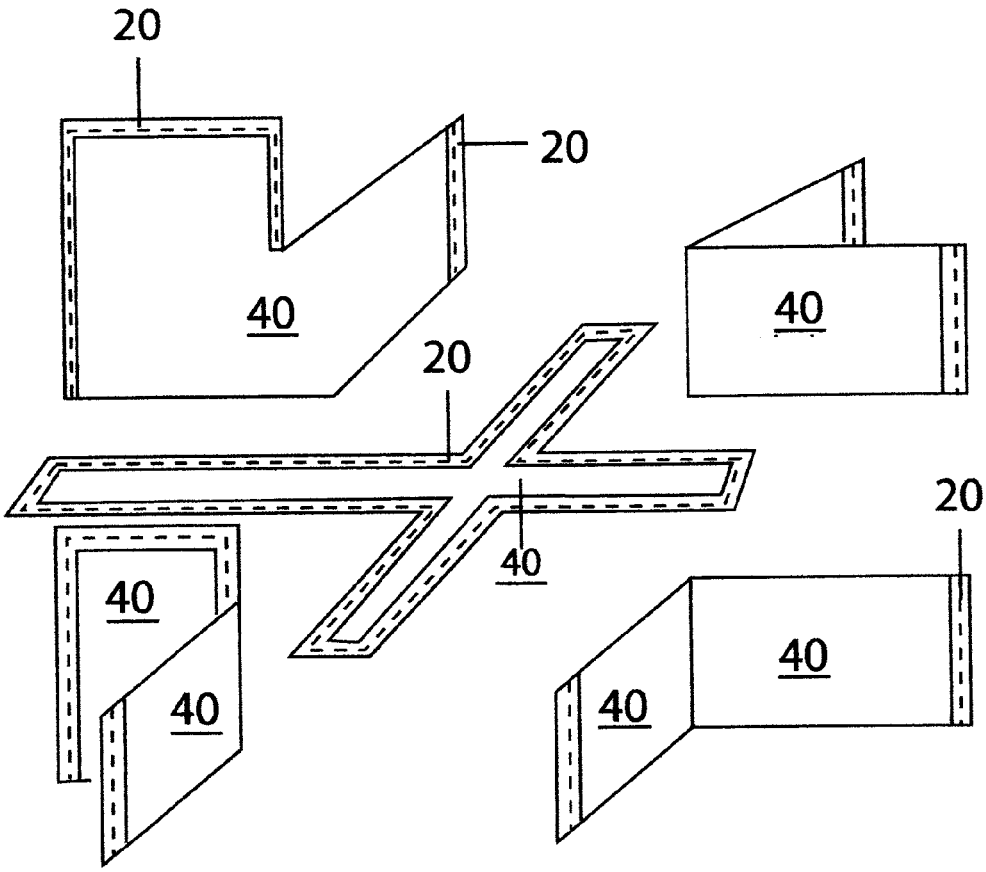
FIG. 19 is a perspective view of the four additional insulation blanket/intumescent material parts that will complete the side walls for that part of the vertical/horizontal T-shaped intersection-space fire-barrier. These pieces are to be inserted inside of the protective cloth coverings (i.e., shown as a template in FIG. 18*b*. The T-shaped structure (as is shown in FIG. 18.) is in the figure only as a guide for the placement of the insulation blanket/intumescent material parts. This step will complete the assembly of the vertical/horizontal T-shaped intersection-space fire.

FIG. 19 is a perspective view of the four additional insulation blanket/intumescent material parts that will complete the layered side walls for the T-shaped extension arm part of the horizontal T-joint/vertical intersection-space fire-barrier. The insulation blanket/intumescent material parts, as shown in FIG. 19, are to be inserted inside of the protective cloth coverings (i.e., shown as a template in FIG. 18*b*). The cross-shaped structure (as is shown in FIG. 18.) is shown again in this figure only as a guide for the placement of the insulation blanket/intumescent material parts. This step will complete the assembly of the horizontal T-joint/vertical intersection-space fire-barrier.

Figure 19A:
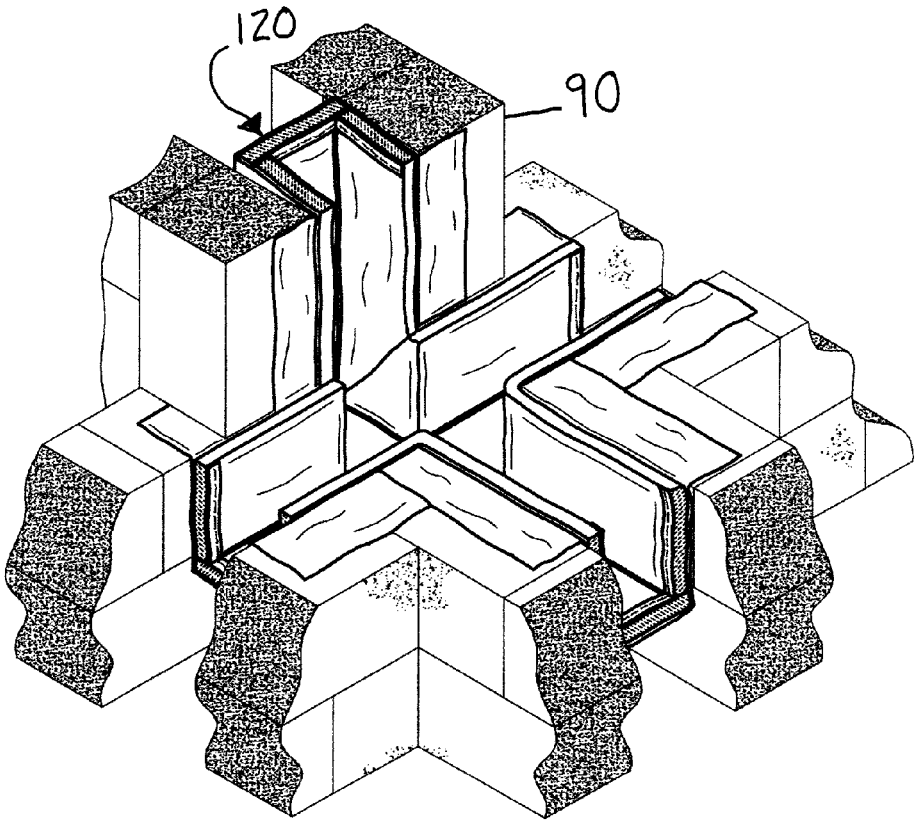
FIG. 19*a* is a perspective view of a vertical/horizontal T-shaped intersection-space fire-barrier installed in a vertical/horizontal T-shaped intersection-space. In this illustration the intumescent strip layer is about to be positioned on the insulation blanket.

FIG. 19*a* is a perspective view of a vertical/horizontal T-shaped intersection-space fire-barrier 120 installed in a model vertical/horizontal T-shaped intersection-space for illustration. In this illustration the intumescent strip layer is about to be positioned on the insulation blanket side walls.

Figure 20A:
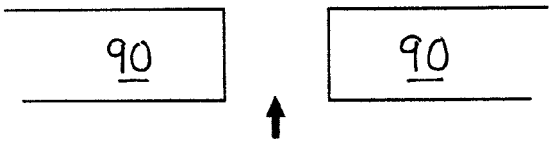
FIG. 20*a* is a schematic of a simple expansion-joint space formed by spaced building units.
Figure 20B:
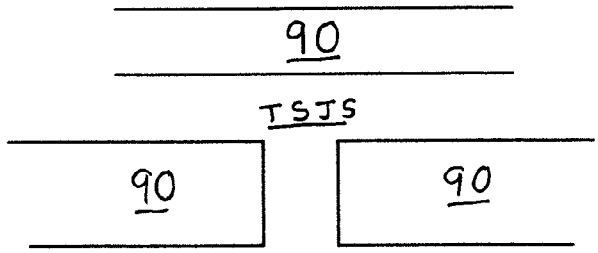
FIG. 20*b* is a schematic of a T-shaped intersecting expansion-joint-space formed by the intersection of two expansion-joint-spaces.
Figure 20C:
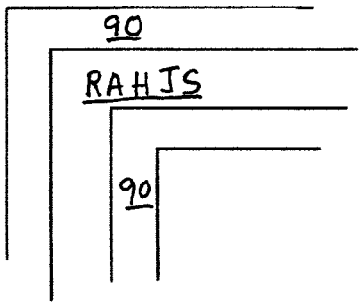
FIG. 20*c* is a schematic of a L-shaped intersecting expansion-joint-space formed by the intersection of two expansion-joint-spaces.
Figure 20D:
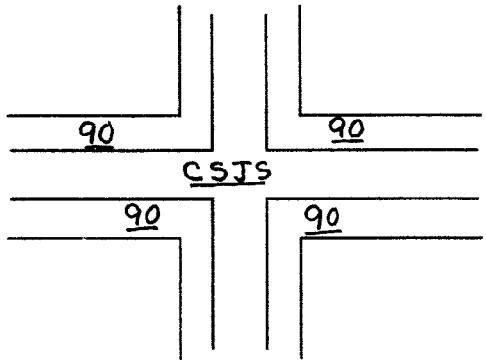
FIG. 20*d* is a schematic of a cross-shaped intersecting expansion-joint-space formed by the intersection of four expansion-joint-spaces.

The layered intersection-space fire-barriers according to the principles of the present invention also provide barriers for use in planar angled expansion-joints created by the intersection of simple, straight-line expansion joints FIG. 20*a*. Three commonly occurring planar expansion-joints are those formed by the planar approximately right-angled intersection of two, three, and four simple expansion-joints resulting in L-shaped, T-shaped, and cross-shaped planar expansion-joints, such as those illustrated schematically in FIGS. 20*b-d*. Of course, it is appreciated that there are many variation of intersection-space expansion-joint structures.

Thus, it can be seen from the above that the present invention provides the solution to the long felt and extremely important safety need for means to prevent the rapid spread of flames, heat, and smoke throughout intersection-space expansion-joints of any type of structure by providing fire-barriers styled and sized to fit intersection-space expansion-joints, as well as the method of making the barriers, and the forms on which the barriers are seamed. Moreover, as the intersection-space fire-barriers of the present invention may be constructed of presented available and permitted materials, the added cost to manufacture the barrier is minimal, thus making these essential safety features, affordable.

The foregoing description, for purposes of explanation, used specific and defined nomenclature to provide a thorough understanding of the invention. However, it will be apparent to one skilled in the art that the specific details are not required in order to practice the invention. The disclosed descriptions and illustrations are not intended to be exhaustive or to limit the invention to the precise forms disclosed. Those skilled in the art will recognize that many changes may be made to the features, embodiments, and methods of making the versions of the invention described herein without departing from the spirit and scope of the invention, such as adjusting the template patterns shown in the drawings and described above to fit the variety of other similar, but different, intersection-space expansion-joints, as well as to fit the various sizes of intersection-space joints that require fire-barriers. Furthermore, the present invention is not limited to the described methods, embodiments, features or combinations of features but include all the variation, methods, modifications, and combinations of features within the scope of the appended Claims. The invention is limited only by the Claims.

What is claimed is:

1. A fire barrier, comprising:

a fire-barrier sized and shaped for installation into an accepting intersection-spaces formed by the intersection of at least two expansion-joint spaces that each occur between different sets of two adjacent spaced structural building units, said intersection creating a t-shaped, cross-shaped, L-shaped or v-shaped intersection-space, said fire-barrier comprising:

a layer of woven refractory fabric heat-resistant to 2000° F. protective cloth cut, folded, and sewn to shape, overlain by at least one refractory ceramic fiber insulation blanket layer cut to shape, and at least one layer of intumescent material, at least one layer of a mechanical support layer cut to shape and inserted between said protective cloth and said ceramic fiber insulation blanket, and mounting means for fixedly mounting said barrier to the spaced structural building units, said layers together forming a fire-barrier ready for one-step drop-in installation within said an accepting t-shaped, cross-shaped, L-shaped or v-shaped intersection space.

2. The fire-barrier, as recited in claim 1, wherein said mounting means for affixing said layered fire-barrier to said structural building units further comprise flanges extending outwardly from each side of said fire-barrier that is immediately adjacent to said structural building units.

3. The fire-barrier, as recited in claim 2, wherein said flanges comprise side edge portions of said mechanical support layer.

4. The fire-barrier, as recited in claim 2, further comprising a plurality of fasteners used in conjunction with said flanges providing for said fire-barrier to be affixed to said structural building units.

5. The fire-barrier, as recited in claim 4, wherein said plurality of fasteners further comprises a plurality of pins and washers or other fasteners that will perform the equivalent function used in conjunction with said flanges providing for said fire-barrier to be affixed to said structural building units.

6. The fire-barrier, as recited in claim 1, wherein said fire-barrier is manufactured in a cross-shaped for installation into an accepting cross-shaped intersection-space created by the intersection of four expansion-joints.

7. The fire-barrier, as recited in claim 1, wherein said fire-barrier is manufactured in a T-shape for installation into an accepting T-shaped intersection-space.

8. The fire-barrier, as recited in claim 1, wherein said fire-barrier is manufactured in a planar L-shape for installation into a planar accepting right-angled intersection-space of two expansion-joints.

9. The fire-barrier, as recited in claim 1, wherein said fire-barrier is manufactured in a non-planar L-shape for fitting into a non-planar intersection space created by the intersection of two architectural expansion-joints at approximately right angles.

10. The fire-barrier, as recited in claim 9, wherein said non-planar right-angled intersection of two expansion-joints further comprises a spaced-intersection of a vertically oriented expansion-joint space with a horizontally oriented expansion-joint space.

11. The fire-barrier, as recited in claim 1, wherein said fire-barrier further comprises:

a fire-barriers sized and shaped for installation into an accepting intersection-spaces formed by the intersection of expansion joint spaces to form right angled, obtuse angled, or acute angled intersection-expansion-joint spaces.

12. A method for making fire-barriers, comprising:

providing for a fire-barriers sized and shaped for installation into an accepting intersection-spaces formed by the intersection of at least two expansion-joint spaces that each occur between different sets of two adjacent spaced structural building units, said intersection creating a t-shaped, cross-shaped, L-shaped or v-shaped intersection-space, providing for each fire-barrier to be a layered fire-barrier comprising:

a layer of woven refractory fabric heat-resistant to 2000° F. protective cloth cut, folded, and sewn to shape overlain by, at least one refractory ceramic fiber insulation blanket layer, at least one layer containing intumescent material, at least one layer of a mechanical support layer cut to shape and inserted between said protective cloth and said ceramic fiber insulation blanket, said layers together forming a fire-barrier ready for one-step drop-in installation within an accepting t-shaped, cross-shaped, L-shaped or v-shaped intersection-space.

13. The method, as recited in claim 12, wherein said method further comprises:

affixing mounting means flanges extending outwardly from each side of said fire-barrier that is immediately adjacent to said structural building units to said structural building units.

14. The method, as recited in claim 13, wherein said flanges comprise side edge portions of said mechanical support layer.

15. A method for installing a fire-barriers sized and shaped for installation into accepting intersection-spaces formed by the intersection of at least two expansion-joint spaces that occur between two adjacent spaced structural building units, said intersection creating a t-shaped, cross-shaped, L-shaped or v-shaped intersection-space each of said expansion-joint spaces defined by a plane, said plane defined by a set of three non-colinear points with each point defined by a set of x, y, z coordinates from the same coordinate system with no two of said coordinate sets being identical, said method comprising:

providing for said fire-barrier to be a layered fire-barrier comprising:

a layer of woven refractory fabric heat-resistant to 2000° F. protective cloth cut, folded, and sewn to shape overlain by, at least one refractory ceramic fiber insulation blanket layer, at least one layer of intumescent material, at least one layer of a mechanical support layer cut to shape and inserted between said protective cloth and said ceramic fiber insulation blanket, said layers together forming a fire-barrier ready for one-step drop-in installation within an accepting t-shaped, cross-shaped, L-shaped or v-shaped intersection-space, and providing mounting means for fixedly mounting said barrier to structural building units forming said expansion-joints, and mounting said barrier to structural building units.

16. The method, as recited in claim 15, further comprising: manufacturing said fire-barrier in a cross-shaped for installation into an accepting cross-shaped intersection-space created by the intersection of four expansion-joints.

17. The method, as recited in claim 15, further comprising: manufacturing said fire-barrier in a T-shape for fitting into a planar approximately right-angled intersection-space of three expansion-joint spaces.

18. The method, as recited in claim 15, further comprising: manufacturing said fire-barrier in an L-shape for fitting into a planar approximately right-angled intersection-space created by the intersection of two expansion-joint spaces.

19. The method, as recited in claim 15, further comprising manufacturing said fire-barrier in an L-shape for fitting into a non-planar approximately right-angled intersection-space created by the spaced-intersection of two expansion-joint spaces at approximately right-angles.

20. The method, as recited in claim 15, wherein said non-planar approximately right-angled intersection-space created by the intersection of two expansion-joints further comprises an spaced-intersection of a vertically oriented expansion-joint space with a horizontally oriented expansion-joint space.

* * * * *

UNITED STATES PATENT AND TRADEMARK OFFICE

CERTIFICATE OF CORRECTION

PATENT NO. : 8,286,397 B2
APPLICATION NO. : 12/827033
DATED : October 16, 2012
INVENTOR(S) : Alan Shaw It is certified that error appears in the above-identified patent and that said Letters Patent is hereby corrected as shown below:

On the Title Page, item (63) under the subtitle Related U.S. Application Data: in line five, the phrase "continuation-in-part" should read -- continuation -- of application No. 10/854,392, filed on May 26, 2004, now abandoned.

Signed and Sealed this
Twenty-ninth Day of January, 2013

David J. Kappos

David J. Kappos
*Director of the United States Patent and Trademark Office*